US008217862B2

(12) United States Patent
Minami et al.

(10) Patent No.: US 8,217,862 B2
(45) Date of Patent: Jul. 10, 2012

(54) DISPLAY APPARATUS, DRIVING METHOD FOR DISPLAY APPARATUS AND ELECTRONIC APPARATUS

(75) Inventors: Tetsuo Minami, Tokyo (JP); Masatsugu Tomida, Kanagawa (JP)

(73) Assignee: Sony Corporation, Tokyo (JP)

( * ) Notice: Subject to any disclaimer, the term of this patent is extended or adjusted under 35 U.S.C. 154(b) by 936 days.

(21) Appl. No.: 12/285,266

(22) Filed: Oct. 1, 2008

(65) Prior Publication Data

US 2009/0109146 A1 Apr. 30, 2009

(30) Foreign Application Priority Data

Oct. 25, 2007 (JP) ..... 2007-277158

(51) Int. Cl.
*G09G 3/30* (2006.01)

(52) U.S. Cl. ..... 345/76; 345/78

(58) Field of Classification Search ..... 345/76–78
See application file for complete search history.

(56) References Cited

U.S. PATENT DOCUMENTS

| | | | | |
|---|---|---|---|---|
| 2004/0174349 | A1* | 9/2004 | Libsch et al. | 345/204 |
| 2004/0263437 | A1* | 12/2004 | Hattori | 345/76 |
| 2005/0206590 | A1* | 9/2005 | Sasaki et al. | 345/76 |
| 2007/0115225 | A1* | 5/2007 | Uchino et al. | 345/76 |

FOREIGN PATENT DOCUMENTS

| | | | |
|---|---|---|---|
| JP | 2003-271095 | A | 9/2003 |
| JP | 2005-258326 | A | 9/2005 |
| JP | 2006-133542 | | 5/2006 |
| JP | 2006-330223 | A | 12/2006 |
| JP | 2007-140318 | A | 6/2007 |
| JP | 2007-171828 | A | 7/2007 |
| JP | 2007-206273 | A | 8/2007 |

OTHER PUBLICATIONS

Japanese Office Action issued Feb. 28, 2012 for corresponding Japanese Application No. 2007-277158.

* cited by examiner

*Primary Examiner* — Nitin Patel
*Assistant Examiner* — Dorothy Harris
(74) *Attorney, Agent, or Firm* — Rader Fishman & Grauer, PLLC

(57) ABSTRACT

Disclosed herein is a display apparatus, including: a pixel array section having a plurality of pixels each including an electro-optical element, a writing transistor, a driving transistor, and a holding capacitor; a power supply scanning circuit; and a signal outputting circuit; wherein the power supply scanning circuit is operable to supply a second power supply potential to initialize the potential of a second electrode of the driving transistor and then change over the potential of a power supply line to a first power supply potential; and the signal outputting circuit is operable to output, when the writing transistor is in a conducting state, a first reference potential, supply, midway while a threshold value correction process is carried out, a second reference potential, output a third reference potential within a period within which the writing transistor remains in the conducting state, and output a image signal after the threshold correction process ends.

7 Claims, 14 Drawing Sheets

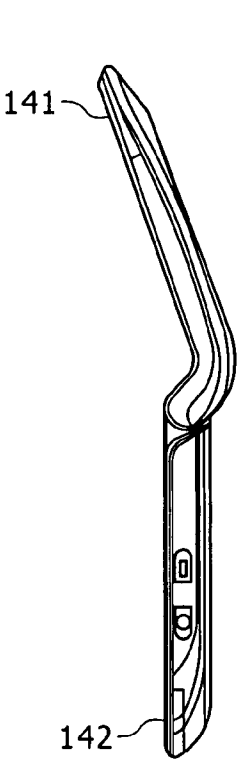
FIG.17A
FIG.17B
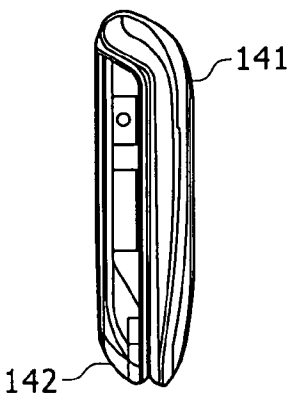
FIG.17D
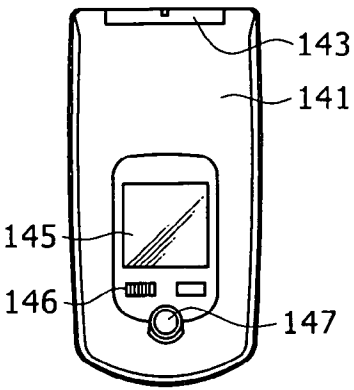
FIG.17C
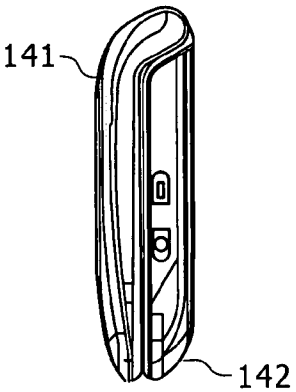
FIG.17E
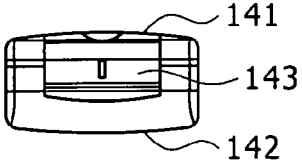
FIG.17F
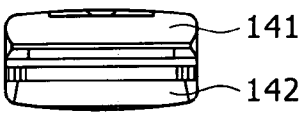
FIG.17G

DISPLAY APPARATUS, DRIVING METHOD FOR DISPLAY APPARATUS AND ELECTRONIC APPARATUS

CROSS REFERENCES TO RELATED APPLICATIONS

The present invention contains subject matter related to Japanese Patent Application JP 2007-277158 filed in the Japan Patent Office on Oct. 25, 2007, the entire contents of which being incorporated herein by reference.

BACKGROUND OF THE INVENTION

1. Field of the Invention

This invention relates to display apparatuses, driving methods for a display apparatus and electronic apparatuses, and more particularly to a display apparatus of the flat type or flat panel type wherein a plurality of pixels including electro-optical elements are disposed in rows and columns, that is, in a matrix, and a driving method for the display apparatus and an electronic apparatus including the display apparatus.

2. Description of the Related Art

In recent years, in the field of display apparatus for displaying an image, flat type display apparatus wherein pixels or pixel circuits including light emitting elements are disposed in a matrix have been popularized rapidly. As a flat type display apparatus, a display apparatus which uses an electro-optical element of the current driven type whose emission light luminance varies in response to the value of current flowing through the element, for example, an organic EL (Electro Luminescence) display apparatus which uses an organic EL element which utilizes a phenomenon that an organic thin film emits light when an electric field is applied thereto, has been developed and commercialized.

The organic EL display apparatus has the following characteristics. In particular, it exhibits low power consumption because the organic EL element can be driven by an application voltage equal to or lower than 10 V. Further, since the organic EL element is a selfluminous element, the organic display apparatus displays an image of high visual observability in comparison with a liquid crystal display apparatus wherein the intensity of light from a light source or backlight is controlled by the liquid crystal cell for each pixel. Besides, since the organic EL display apparatus does not require an illumination member such as a backlight, it is easy to reduce the weight and the thickness thereof. Further, since the response speed of the organic EL element is approximately several μsec and very high, an afterimage upon dynamic image display does not appear.

The organic EL display apparatus can adopt a simple or passive matrix method and an active matrix method as a driving method therefor similarly as in the liquid crystal display apparatus. However, although the display apparatus of the passive matrix type is simple in structure, it has such a problem that, since the light emission period of the electro-optical elements decreases as the number of scanning lines or the number of pixels increases, it is difficult to implement a display apparatus of a large size and of high definition.

Therefore, in recent years, a display apparatus of the active matrix type has been and is being developed energetically wherein the current flowing to an electro-optical element is controlled by an active element provided in the same pixel circuit as the electro-optical element such as an insulating gate type field effect transistor, usually a thin film transistor (TFT). A display apparatus of the active matrix type can be easily formed as a display apparatus of a large size and high definition because the electro-optical element continues to emit light for a period of one frame.

Incidentally, it is generally known that the I-V characteristic, that is, the current-voltage characteristic, of an organic EL element deteriorates as time passes, that is, exhibits long-term deterioration. In a pixel circuit which uses a TFT of the N-channel type as a transistor for current-driving an organic EL element (such a transistor is hereinafter referred to as driving transistor), since the organic EL element is connected to the source side of the driving transistor, if the I-V characteristic of the organic EL element suffers from long-term deterioration, then the gate-source voltage Vgs of the driving transistor varies. As a result, also the emission light luminance of the organic EL element varies.

This is described more particularly. The source potential of the driving transistor depends upon the working point of the driving transistor and the organic EL element. Then, if the I-V characteristic of the organic EL element deteriorates, then since the working point of the driving transistor and the organic EL element varies, even if the same voltage is applied to the gate of the driving transistor, the source potential of the driving transistor varies. Consequently, the gate-source voltage Vgs of the driving transistor varies, and the value of current flowing through the driving transistor varies. As a result, also the value of current flowing through the organic EL element varies, and this varies the emission light luminance of the organic EL element.

Meanwhile, a pixel circuit which uses a polycrystalline silicon TFT suffers not only from long-term deterioration of the I-V characteristic of the organic EL element but also from secular change of the threshold voltage Vth of the driving transistor or the mobility of a semiconductor thin film which composes a channel of the driving transistor (such mobility is hereinafter referred to as mobility of the driving transistor). Further, with the pixel circuit, the threshold voltage Vth or the mobility μ differs for each pixel from a dispersion in the fabrication process. In other words, each transistor has a dispersion in characteristics.

Where the threshold voltage Vth or the mobility μ of the driving transistor differs for each pixel, also the value of current flowing to the driving current disperses for each pixel. Therefore, even if the same voltage is applied to the gate of the driving transistors of the pixels, a dispersion in the emission light luminance of the organic EL element appears between the pixels. As a result, uniformity of the screen image is damaged.

Therefore, in order to keep the emission light luminance of the organic EL element fixed without being influenced, even if the I-V characteristic of the organic EL element suffers from long-term deterioration or the threshold voltage Vth or the mobility μ of the driving transistor suffers from secular change, by such long-term deterioration or secular change, the following configuration is adopted. In particular, each pixel circuit is provided with a compensation function for the characteristic variation of the organic EL element or a correction function for correction against the variation of the threshold voltage Vth of the driving transistor (such correction is hereinafter referred to as threshold value correction) or for correction against the variation of the mobility μ of the driving transistor (such correction is hereinafter referred to as mobility correction). The configuration just described is disclosed, for example, in Japanese Patent Laid-Open No. 2006-133542 (hereinafter referred to as Patent Document 1).

By providing each pixel circuit with a compensation function for the characteristic variation of the organic EL element and correction functions against the threshold voltage Vth and the mobility μ of the driving transistor in this manner, even if the I-V characteristic of the organic EL element suffers from long-term deterioration of the threshold voltage Vth or the mobility μ of the driving transistor suffers from secular change, the emission light luminance of the organic EL element can be kept fixed without being influenced by such long-term deterioration or secular change as described above.

SUMMARY OF THE INVENTION

In the configuration of Patent Document 1, each pixel circuit is provided with a compensation function for the characteristic variation of the organic EL element and a correction function for correction against the variation of the threshold voltage Vth and the mobility μ of the driving transistor as described above. Therefore, even if the I-V characteristic of the organic EL element suffers from long-term deterioration or the threshold voltage Vth or the mobility μ of the driving transistor suffers from secular change, the emission light luminance of the organic EL element can be kept fixed without being influenced by such long-term deterioration or secular change as described above. However, the number of pixels which form the pixel circuit is comparatively great, and this makes an obstacle to refinement of the pixel size and hence to achievement of higher definition of the display apparatus.

Meanwhile, a pixel circuit which achieves reduction of the number of component pixels and wiring lines has been proposed by the assignee of the present application and is disclosed in Japanese Patent Application No. 2006-141836. The pixel circuit uses a plurality of different potentials one of which is selectively supplied as a power supply potential, for example, to a driving transistor of the pixel circuit thereby to omit a transistor for switching the power supply potential between the potentials to control an organic EL element between a light emitting state and a no-light emitting state and a transistor for initializing the source potential of the driving transistor. Further, the pixel circuit is configured such that a reference potential to be applied as a gate potential to the driving transistor is supplied from a signal line used for an image signal thereby to omit a transistor for initializing the gate potential to the driving transistor.

Where the pixel configuration just described is adopted, a pixel circuit can be formed from a minimum number of necessary components. In particular, a pixel circuit can be composed of a writing transistor for writing an image signal representative of luminance information into a pixel, a holding capacitor for holding the signal voltage of the image signal written by the writing transistor, and a driving transistor for driving an organic EL element based on the signal voltage of the image signal held in the holding capacitor.

In the case of the pixel circuit just described, when the writing transistor is placed into a conducting state, a reference potential Vofs supplied through a signal line is applied to the gate electrode of the driving transistor to carry out a threshold value correction process. However, when the threshold value correction period comes to an end and the writing transistor is placed into a non-conducting state, the gate electrode of the driving transistor is electrically disconnected from the signal line. Consequently, a period within which the gate electrode of the driving transistor exhibits a floating state appears within a period after the threshold correction until the image signal is written.

If the gate electrode of the driving transistor enters a floating state in this manner, then both of the gate potential and the source potential of the driving transistor rise from a reason hereinafter described, resulting in failure to carry out a desired threshold value correction process. This makes it difficult to sufficiently achieve an improving effect of the display quality or picture quality by the threshold value correction process.

Therefore, it is desirable to provide a display apparatus which can achieve further improvement of the display quality through certain execution of a desired threshold value correction process and further provide a driving method suitable for the display apparatus and an electronic apparatus which uses the display apparatus.

According to an embodiment of the present invention, there is provided a display apparatus including a pixel array section having a plurality of pixels disposed in a matrix and each including: an electro-optical element; a writing transistor connected at a gate electrode thereof to a scanning line and at a first one of electrodes thereof to a signal line; a driving transistor connected at a gate electrode thereof to a second one of the electrodes of the writing transistor, at a first one of electrodes thereof to a power supply line and at a second one of the electrodes thereof to an anode electrode of the electro-optical element; and a holding capacitor connected at a first one of electrodes thereof to the gate electrode of the driving transistor and at a second one of the electrodes thereof to the second electrode of the driving transistor. The display apparatus further includes a power supply scanning circuit (DS) configured to selectively supply a first power supply potential (Vccp) and a second power supply potential (Vini) which is lower than the first power supply potential to the power supply line, and a signal outputting circuit configured to selectively output an image signal (Vsig of FIG. 12), a first reference potential (Vofs1 of FIG. 12), a second reference potential (Vofs2 of FIG. 12) lower than the first reference potential and a third reference potential (Vofs3 of FIG. 12) higher than the second reference potential to the signal line. The power supply scanning circuit is operable to supply the second power supply potential to the second electrode of the driving transistor through the power supply line to initialize the potential of the second electrode of the driving transistor and then change over the potential of the power supply line from the second power supply potential to the first power supply potential. The signal outputting circuit is operable to output, when the writing transistor is in a conducting state in response to a scanning signal supplied thereto through the scanning line, the first reference potential (Vofs1) to the signal line so as to be supplied to the gate electrode of the driving transistor through the writing transistor to initialize the potential of the gate electrode of the driving transistor, supply, midway while a threshold value correction process of varying the potential of the second electrode of the driving transistor toward a potential which is the difference of a threshold voltage of the driving transistor from an initialization potential for the gate electrode of the driving transistor with reference to the initialization potential is carried out, the second reference potential (Vofs2) to the signal light in place of the first reference potential so as to be supplied to the gate electrode of the driving transistor through the writing transistor, output the third reference potential (Vofs3) in place of the second reference potential to the signal line within a period within which the writing transistor remains in the conducting state, and output the image signal (Vsig) in place of the third reference potential to the signal line after the threshold correction process ends.

According to another embodiment of the present invention, there is provided a driving method for a display apparatus which includes a pixel array section having a plurality of pixels disposed in a matrix and each including: an electro-optical element; a writing transistor connected at a gate electrode thereof to a scanning line and at a first one of electrodes thereof to a signal line; a driving transistor connected at a gate electrode thereof to a second one of the electrodes of the writing transistor, at a first one of electrodes thereof to a power supply line and at a second one of the electrodes thereof to an anode electrode of the electro-optical element; and a holding capacitor connected at a first one of electrodes thereof to the gate electrode of the driving transistor and at a second one of the electrodes thereof to the second electrode of the driving transistor. The driving method selectively changes over a potential of the power supply line to a first power supply potential and a second power supply potential which is lower than the first power supply potential. The driving method includes the steps of: supplying the second power supply potential to the second electrode of the driving transistor through the power supply line to initialize the potential of the second electrode of the driving transistor and then writing, when the writing transistor is in a conducting state, the first reference potential into the gate electrode of the driving transistor through the writing transistor to initialize the potential of the gate electrode of the driving transistor; and changing over the potential of the power supply line from the second power supply potential to the first power supply potential. The driving method further includes the steps of: carrying out a threshold value correction process of varying the potential of the second electrode of the driving transistor toward a potential which is the difference of a threshold voltage of the driving transistor from an initialization potential for the gate electrode of the driving transistor with reference to the initialization potential; and writing a second reference potential lower than the first reference potential in place of the first reference potential into the gate electrode of the driving transistor through the writing transistor midway while the threshold value correction process is carried out. The driving method still further includes the steps of: writing a third reference potential higher than the second reference potential in place of the second reference potential into the gate electrode of the driving transistor through the writing transistor within a period within which the writing transistor remains in the conducting state; and writing an image signal in place of the third reference potential into the gate electrode of the driving transistor through the writing transistor which is placed into a conducting state again after the threshold correction process ends.

According to still another embodiment of the present invention, there is provided an electronic apparatus including a display apparatus including a pixel array section having a plurality of pixels disposed in a matrix and each including: an electro-optical element; a writing transistor connected at a gate electrode thereof to a scanning line and at a first one of electrodes thereof to a signal line; a driving transistor connected at a gate electrode thereof to a second one of the electrodes of the writing transistor, at a first one of electrodes thereof to a power supply line and at a second one of the electrodes thereof to an anode electrode of the electro-optical element; and a holding capacitor connected at a first one of electrodes thereof to the gate electrode of the driving transistor and at a second one of the electrodes thereof to the second electrode of the driving transistor. The display apparatus further includes: a power supply scanning circuit configured to selectively supply a first power supply potential and a second power supply potential which is lower than the first power supply potential to the power supply line; and a signal outputting circuit configured to selectively output an image signal, a first reference potential, a second reference potential lower than the first reference potential and a third reference potential higher than the second reference potential to the signal line. The power supply scanning circuit is operable to supply the second power supply potential to the second electrode of the driving transistor through the power supply line to initialize the potential of the second electrode of the driving transistor and then change over the potential of the power supply line from the second power supply potential to the first power supply potential. The signal outputting circuit is operable to output, when the writing transistor is in a conducting state in response to a scanning signal supplied thereto through the scanning line, the first reference potential to the signal line so as to be supplied to the gate electrode of the driving transistor through the writing transistor to initialize the potential of the gate electrode of the driving transistor, supply, midway while a threshold value correction process of varying the potential of the second electrode of the driving transistor toward a potential which is the difference of a threshold voltage of the driving transistor from an initialization potential for the gate electrode of the driving transistor with reference to the initialization potential is carried out, the second reference potential to the signal line in place of the first reference potential so as to be supplied to the gate electrode of the driving transistor through the writing transistor, output the third reference potential in place of the second reference potential to the signal line within a period within which the writing transistor remains in the conducting state, and output the image signal in place of the third reference potential to the signal line after the threshold correction process ends.

In the display apparatus having the configuration described above and an electronic apparatus which uses the display apparatus, the reference potential to be written into the gate electrode of the driving transistor midway while the threshold value correction process is carried out is changed over from the first reference potential to the second reference potential which is lower than the first potential. As a result, the gate potential of the driving transistor drops, and consequently, the driving transistor is placed into a non-conducting state with certainty. Consequently, when the threshold value correction process comes to an end and the writing transistor is placed into a non-conducting state to electrically disconnect the gate electrode of the driving transistor from the signal line to place the gate electrode of the driving transistor into a floating state, appearance of current leak of the driving transistor can be suppressed.

Then, after the threshold value correction process comes to an end, the potential of the gate electrode of the driving transistor is settled to the second reference potential which is lower than the first reference potential. Thereafter, the potential of the gate electrode of the driving transistor is changed over from the second reference potential to the third reference position which is higher than the second reference potential, and the third reference potential is maintained till a point of time immediately prior to writing of the image signal. Consequently, upon writing of the image signal into the signal line by the signal outputting circuit, the image signal may be written not from the second reference potential but from the third reference potential which is higher than the second reference potential. Therefore, the writing process of the image signal can be carried out stably.

With the display apparatus and the electronic apparatus, since no leak current flows to the driving transistor when the gate electrode of the driving transistor is in a floating state, the potential of the second electrode of the driving transistor does not vary. Accordingly, since the difference in emission light luminance between pixels arising from a dispersion of leak current of the driving transistor can be suppressed, the threshold value correction process does not become incomplete or does not become excessive. Thus, a desired threshold value correction process can be executed, and an effect of improvement of the display quality by the threshold value correction process can be achieved sufficiently.

Besides, after the threshold value correction process comes to an end, the reference potential to be applied to the gate electrode of the driving transistor is changed over from the second reference potential to the third reference potential which is higher than the second reference potential and the third reference potential is continued till a point of time immediately prior to writing of an image signal. Consequently, since the image signal may be written not from the second reference potential but from the third reference potential which is higher than the second reference potential, a writing process of the image signal can be carried out stably and the display quality can be further improved.

The above and other features and advantages according to embodiments of the present invention will become apparent from the following description and the appended claims, taken in conjunction with the accompanying drawings in which like parts or elements denoted by like reference symbols.

BRIEF DESCRIPTION OF THE DRAWINGS

FIGS. 17A and 17B are a front elevational view and a side elevational view, respectively, showing appearances of a portable telephone set, to which an embodiment of the present invention is applied, in an unfolded state and FIGS. 17C to 17G are a front elevational view, a left side elevational view, a right side elevational view, a top plan view and a bottom plan view, respectively, of the portable telephone set in a folded state.

DETAILED DESCRIPTION OF THE PREFERRED EMBODIMENT

System Configuration

Figure 1:
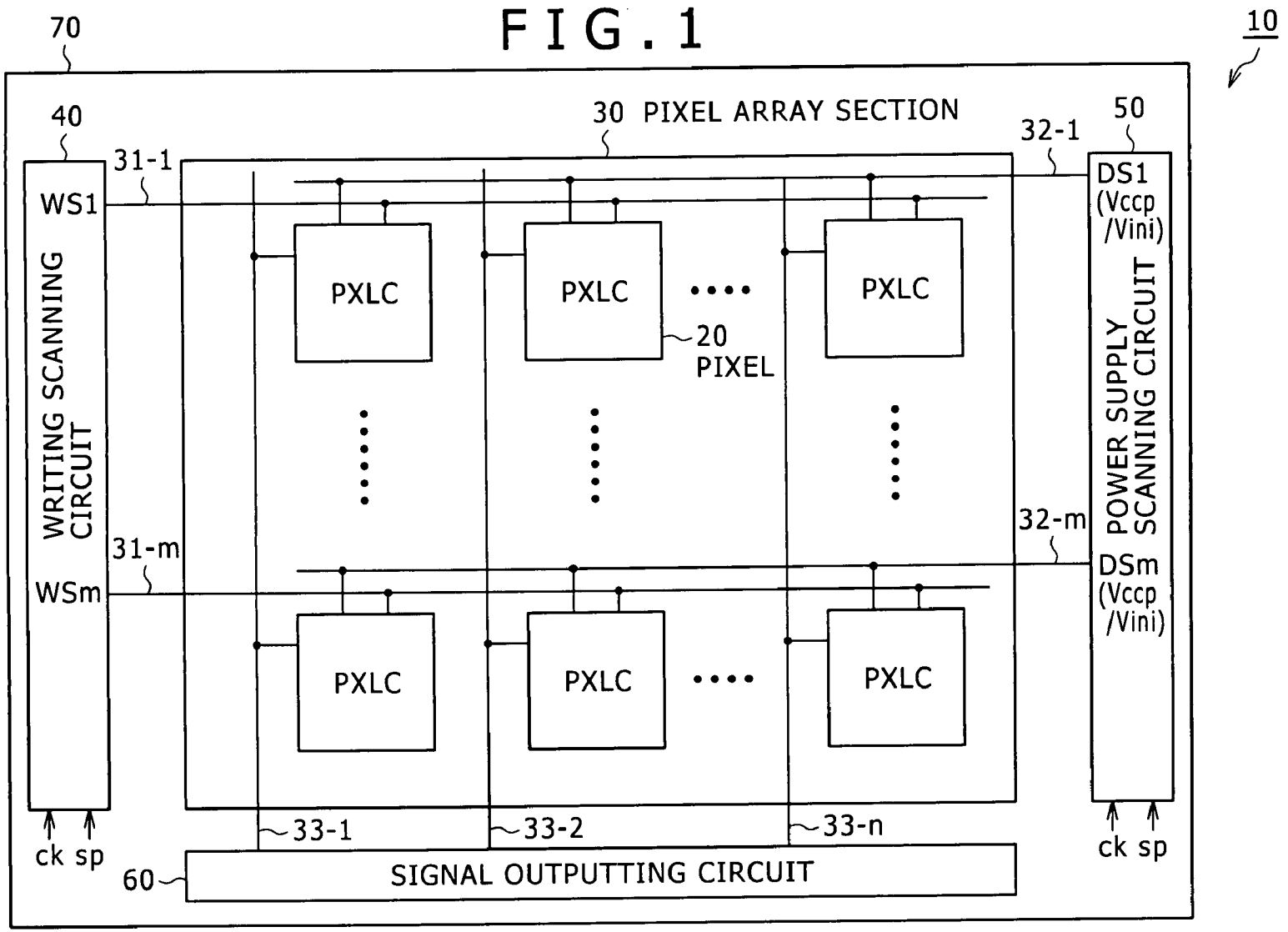
FIG. 1 is a system diagram showing a general configuration of an organic EL display apparatus to which an embodiment of the present invention is applied.

FIG. 1 shows a general configuration of an active matrix type display apparatus to which an embodiment of the present invention is applied.

Here, the active matrix type display apparatus uses, as a light emitting element for a pixel or pixel circuit, an electro-optical element of the current driven type whose emission light luminance varies in response to the value of current flowing therethrough. Thus, it is assumed that the active matrix type display apparatus described below is an active matrix type organic EL display apparatus which uses an organic EL element, that is, an organic electroluminescence element as a light emitting element of a pixel or pixel circuit.

Referring to FIG. 1, the organic EL display apparatus 10 includes a plurality of pixels (PXLC) 20 including light emitting elements, a pixel array section 30 wherein the pixels 20 are disposed two-dimensionally in rows and columns, that is, in a matrix, and driving sections disposed around the pixel array section 30 for driving the pixels 20. The driving sections for driving the pixels 20 include, for example, a writing scanning circuit 40, a power supply scanning circuit 50, and a signal outputting circuit 60.

Here, where the organic EL display apparatus 10 is configured for color display, each pixel is formed from a plurality of sub pixels, and each sub pixel corresponds to a pixel 20. More particularly, in a display apparatus for color display, one pixel is formed from a sub pixel for emitting red light (R), another sub pixel for emitting green light (G) and a further sub pixel for emitting blue light (B).

However, one pixel is not limited to a combination of sub pixels of the three primary colors of R, G and B, but may be formed additionally including a sub pixel for one color or a plurality of sub pixels of different colors. More particularly, for example, one pixel may be formed additionally including a sub pixel for emitting white light (W) for increasing the luminance, or additionally including at least one sub pixel for emitting light of complementary color light for expanding the color reproduction range.

The pixel array section 30 includes scanning lines 31-1 to **31-*m* and power supply lines 32-1 to 32-*m* wired for the individual pixel rows along a first direction, in FIG. 1, in the leftward and rightward direction, that is, in a horizontal direction, in the array of the m rows and the n columns. The pixel array section 30 further includes signal lines 33-1 to 33-*n* wired for the individual pixel columns along a second direction perpendicular to the first direction, in FIG. 1**, in the upward and downward direction, that is, in a vertical direction.

The scanning lines 31-1 to **31-*m* are connected to output terminals of corresponding rows of the writing scanning circuit 40. The power supply lines 32-1 to 32-*m* are connected to output terminals of corresponding rows of the power supply scanning circuit 50. The signal lines 33-1 to 33-*n* are connected to output terminals of corresponding columns of the signal outputting circuit 60**.

The pixel array section 30 is normally formed on a transparent insulating substrate such as a glass substrate. Consequently, the organic EL display apparatus 10 has a flat panel structure. The driving circuits for the pixels 20 of the pixel array section 30 can be formed using an amorphous silicon TFT or a low-temperature polycrystalline silicon TFT. Where a low-temperature polycrystalline silicon TFT is used, also the writing scanning circuit 40, power supply scanning circuit 50 and signal outputting circuit 60 can be mounted on a display panel or substrate 70 which forms the pixel array section 30.

The writing scanning circuit 40 is formed from a shift register which shifts or transfers a start pulse sp successively in synchronism with a clock pulse ck or from a like element. Upon writing of an image signal into the pixels 20 of the pixel array section 30, writing pulses or scanning signals WS1 to WSm are successively supplied to the scanning lines 31-1 to **31-*m* to scan the pixels 20 of the pixel array section 30** in order in a unit of a row (line sequential scanning).

The power supply scanning circuit 50 is formed from a shift register which successively shifts the start pulse sp in synchronism with the clock pulse ck or from a like element. The power supply scanning circuit 50 supplies power supply line potential DS1 to DSm, which are changed over by a first power supply potential Vccp and a second power supply potential Vini which is lower than the first power supply potential Vccp, to the power supply lines 32-1 to **32-*m*, respectively, in synchronism with the line sequential scanning by the writing scanning circuit 40 to control the pixels 20 between a light emitting state and a no-light emitting state. The power supply scanning circuit 50** further supplies driving current to the organic EL elements as light emitting elements.

The signal outputting circuit 60 suitably selects one of a signal voltage Vsig of an image signal, which corresponds to luminance information supplied thereto from a signal supplying source not shown, and a reference potential Vofs, and writes the selected voltage into the pixels 20 of the pixel array section 30, for example, in a unit of a row, through the signal lines 33-1 to **33-*n*. In other words, the signal outputting circuit 60** uses a line sequential writing driving form wherein the signal voltage Vsig of the image signal written in a unit of a row or line.

The reference potential Vofs is a voltage which makes a reference for the signal voltage Vsig of the image signal according to luminance information, that is, a potential corresponding to the black level. Meanwhile, the second power supply potential Vini is set to a potential lower than the reference potential Vofs, for example, a potential lower than Vofs−Vth where Vth is a threshold voltage of a driving transistor 22, preferably a potential sufficiently lower than Vofs−Vth.

Pixel Circuit

Figure 2:
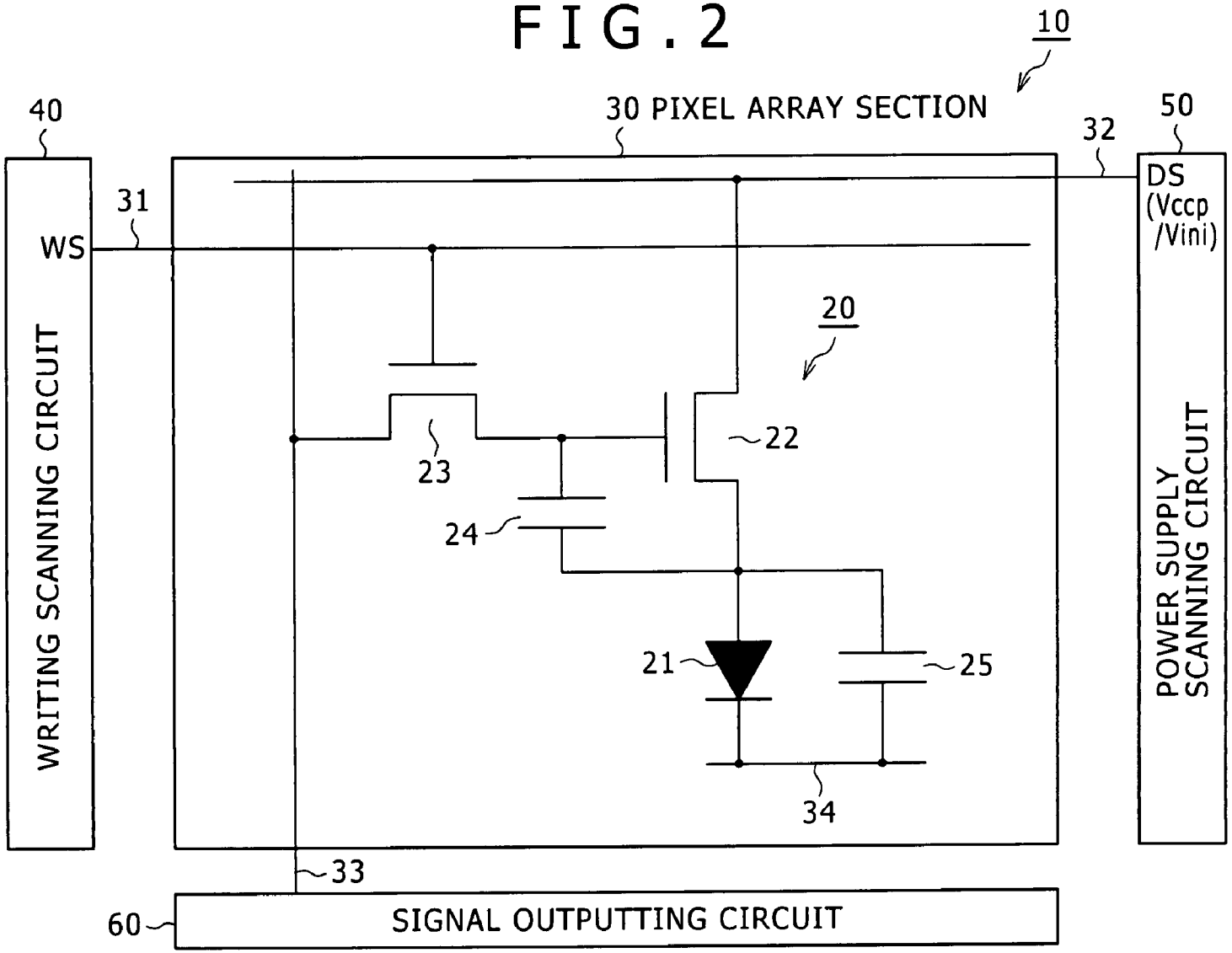
FIG. 2 is a circuit diagram showing an example of a particular configuration of a pixel or pixel circuit of the organic EL display apparatus of FIG. 1.

FIG. 2 shows an example of a particular configuration of a pixel or pixel circuit 20.

Referring to FIG. 2, the pixel 20 includes an electro-optical element of the current driven type whose emission light luminance varies in response to the value of current flowing therethrough, for example, an organic EL element 21, and a driving circuit for driving the organic EL element 21. The organic EL element 21 is connected at the cathode electrode thereof to a common power supply line 34 which is solidly wired commonly to all of the pixels 20.

The driving circuit for driving the organic EL element 21 is composed of a driving transistor 22, a writing transistor 23, a holding capacitor 24 and a sub capacitor 25. Here, an N-channel type TFT is used for the driving transistor 22 and the writing transistor 23. However, the combination of the conduction types of the driving transistor 22 and the writing transistor 23 is a mere example, and a different combination of conduction types may be adopted.

It is to be noted that, if an N-channel TFT is used for the driving transistor 22 and the writing transistor 23, then an amorphous silicon (a-Si) process can be used. Where the a-Si process is used, reduction of the cost for a substrate for producing TFTS, and hence, reduction of the cost for the organic EL display apparatus 25, can be anticipated. Further, if the driving transistor 22 and the writing transistor 23 are formed from TFTs of the same conduction type, then the two transistors 22 and 23 can be produced by the same process, and consequently, further reduction of the cost can be anticipated.

The driving transistor 22 is connected at one of the electrodes thereof, that is, at one of the source and drain electrodes thereof, to the anode electrode of the organic EL element 21 and at the other one of the electrodes thereof, that is, at the other one of the source and drain electrodes thereof, to a power supply line 32 which is one of the power supply lines 32-1 to **32-*m***.

The writing transistor 23 is connected at the gate electrode thereof to a scanning line 31 which is one of the scanning lines 31-1 to **31-*m* and at one of the source and drain electrodes thereof to a signal line 33 which is one of the signal lines 33-1 to 33-*n*. The writing transistor 23 is connected at the other one of the source and drain electrodes thereof to the gate electrode of the driving transistor 22**.

In regard to the driving transistor 22 and the writing transistor 23, one of the electrodes is a metal wiring line electrically connected to one of the source and drain regions and the other one of the electrodes is another metal wiring line electrically connected to the other one of the source and drain regions. Further, depending upon the potential relationship between the one electrode and the other electrode, the one of the electrodes may be the source electrode or the drain electrode, and the other one of the electrodes may be the drain electrode or the source electrode. In the following description, the one electrode will be referred to as a first electrode, and the other electrode will be referred to as a second electrode.

The holding capacitor 24 is connected at one of the electrodes thereof to the gate electrode of the driving transistor 22 and at the other electrode thereof to the other electrode of the driving transistor 22 and the anode electrode of the organic EL element 21.

The sub capacitor 25 is connected at one terminal thereof to the anode electrode of the organic EL element 21 and at the other terminal thereof to the common power supply line 34. The sub capacitor 25 is provided as occasion demands in order to supplement shortage of the capacitance of the organic EL element 21 to increase the writing gain of an image signal to the holding capacitor 24. In other words, the sub capacitor 25 is not an essentially required component but can be omitted where the organic EL element 21 has a sufficient capacitance.

It is to be noted here that, while it is described above that the second electrode of the sub capacitor 25 is connected to the common power supply line 34, the connection destination of the second electrode is not limited to the common power supply line 34 but may be a node of a fixed potential. If the second electrode of the sub capacitor 25 is connected to a node of a fixed potential, then the initial object of supplementing shortage of the capacitance of the organic EL element 21 to raise the writing gain of the image signal to the holding capacitor 24 can be achieved.

In the pixel 20 of the configuration described above, the writing transistor 23 enters a conducting state in response to the scanning signal WS of the high level applied to the gate electrode thereof from the writing scanning circuit 40 through the scanning line 31 to sample the signal voltage Vsig of the image signal according to the luminance information or the offset voltage Vofs supplied thereto from the signal outputting circuit 60 through the signal line 33 and writes the sampled signal into the pixel 20. The thus written signal voltage Vsig or offset voltage Vofs is applied to the gate electrode of the driving transistor 22 and held into the holding capacitor 24.

The driving transistor 22 operates, when the potential DS of the power supply line 32 (32-1 to **32-*m*) is the first power supply potential Vccp, in a saturation region while the drain electrode serves as the first electrode and the source electrode serves as the second electrode such that it receives supply of current from the power supply line 32 to drive the organic EL element 21 to emit light. More particularly, while the driving transistor 22 operates in a saturation region, it supplies driving current of a current value according to the voltage value of the signal voltage Vsig held in the holding capacitor 24 to the organic EL element 21 to current-drive the organic EL element 21** to emit light.

Further, when the potential DS of the power supply line 32 (32-1 to **32-*m*) changes over from the first power supply potential Vccp to the second power supply potential Vini, the driving transistor 22 operates as a switching transistor while the source electrode thereof servers as the first electrode and the drain electrode servers as the second electrode such that it stops the supply of driving current to the organic EL element 21 thereby to place the organic EL element 21 into a no-light emitting state. In other words, the driving transistor 22 has a function also as a transistor for controlling the organic EL element 21** between a light emitting state and a no-light emitting state.

By the switching operation of the driving transistor 22, a period within which the organic EL element 21 is in a no-light emitting state, that is, a no-light emitting period, is provided. Then, by carrying out duty control of controlling the ratio between the light emitting period and the no-light emitting period of the organic EL element 21, that is, the duty of the organic EL element 21, afterimage blurring caused by emission of light from the pixels over a period of one frame can be reduced. Consequently, the picture quality particularly of dynamic pictures can be enhanced.

Pixel Structure

Figure 3:
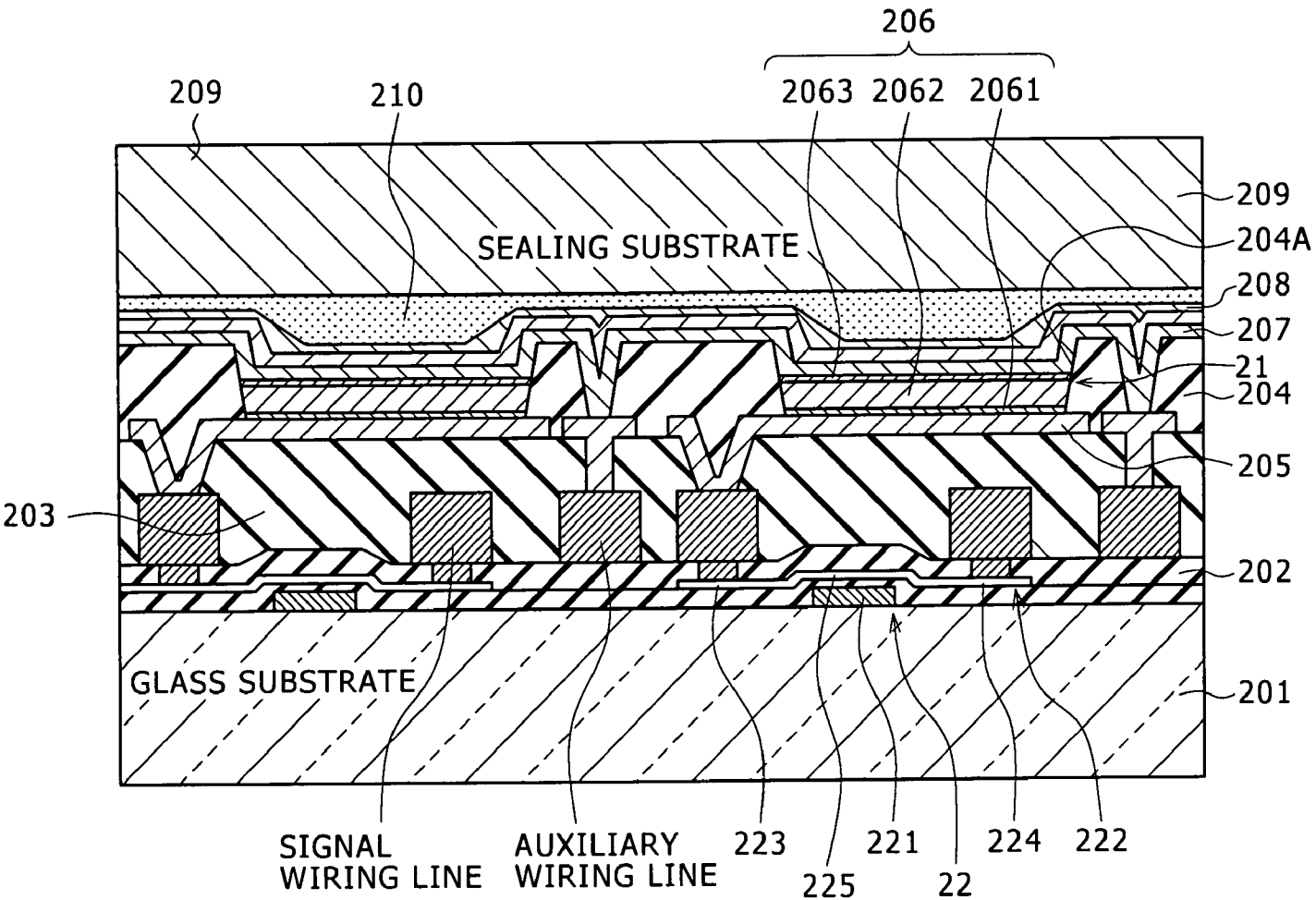
FIG. 3 is a cross sectional view showing an example of a sectional structure of a pixel.

FIG. 3 shows an example of a cross sectional structure of the pixel 20. Referring to FIG. 3, the pixel 20 includes an insulating film 202, an insulating flattening film 203 and a window insulating film 204 formed in order on a glass substrate 201 on which a driving circuit including a driving transistor 22 and so forth are formed. Further, an organic EL element 21 is provided in a recessed portion 204A of the window insulating film 204. Here, only the driving transistor 22 from among the components of the driving circuit is shown while the other components are omitted.

The organic EL element 21 includes an anode electrode 205 made of a metal or the like and formed on the bottom of the recessed portion 204A of the window insulating film 204, an organic layer (electron transport layer, light emitting layer, hole transport layer/hole injection layer) 206 formed on the anode electrode 205. The organic EL element 21 further includes a cathode electrode 207 formed from a transport conductive film or the like common to all pixels on the organic layer 206.

In the organic EL element 21, the organic layer 206 is formed from a hole transport layer/hole injection layer 2061, a light emitting layer 2062, an electron transport layer 2063 and an electron injection layer (not shown) successively deposited on the anode electrode 205. When the organic EL element 21 is driven by current from the driving transistor 22 shown in FIG. 2, current flows from the driving transistor 22 to the organic layer 206 through the anode electrode 205 such that the light emitting layer 2062 in the organic layer 206 emits light when electrons and holes recombine in the light emitting layer 2062.

The driving transistor 22 is composed of a gate electrode 221, a source/drain region 223 provided on one side of a semiconductor layer 222, a drain/source region 224 provided on the other side of the semiconductor layer 222, and a channel formation region 225 provided at a portion of the semiconductor layer 222 opposing to the gate electrode 221. The source/drain region 223 is electrically connected to the anode electrode 205 of the organic EL element 21 through a contact hole.

After the organic EL element 21 is formed in a unit of a pixel on the glass substrate 201, on which the pixel circuits including the driving transistor 22 are formed, with the insulating film 202, insulating flattening film 203 and window insulating film 204 interposed therebetween as seen in FIG. 3, a sealing substrate 209 is adhered to the pixels 20 by a bonding agent 210 with a passivation film 208 interposed therebetween such that the organic EL elements 21 are sealed with the sealing substrate 209 to form the display panel 70.

Circuit Operation of the Organic EL Display Apparatus in an Ideal Operation State Now, circuit operation of the organic EL display apparatus 10, wherein the pixels 20 having the configuration described above are arranged two-dimensionally, in an ideal operation state is described with reference to FIGS. 4 to 6D.

It is to be noted that, in FIGS. 5A to 5D and 6A to 6D, the writing transistor 23 is represented by a symbol of a switch for simplified illustration. Further, the organic EL element 21 has a capacitance component, and the combined resistor of the capacitance component and the sub capacitor 25 is represented by Csub.

Figure 4:
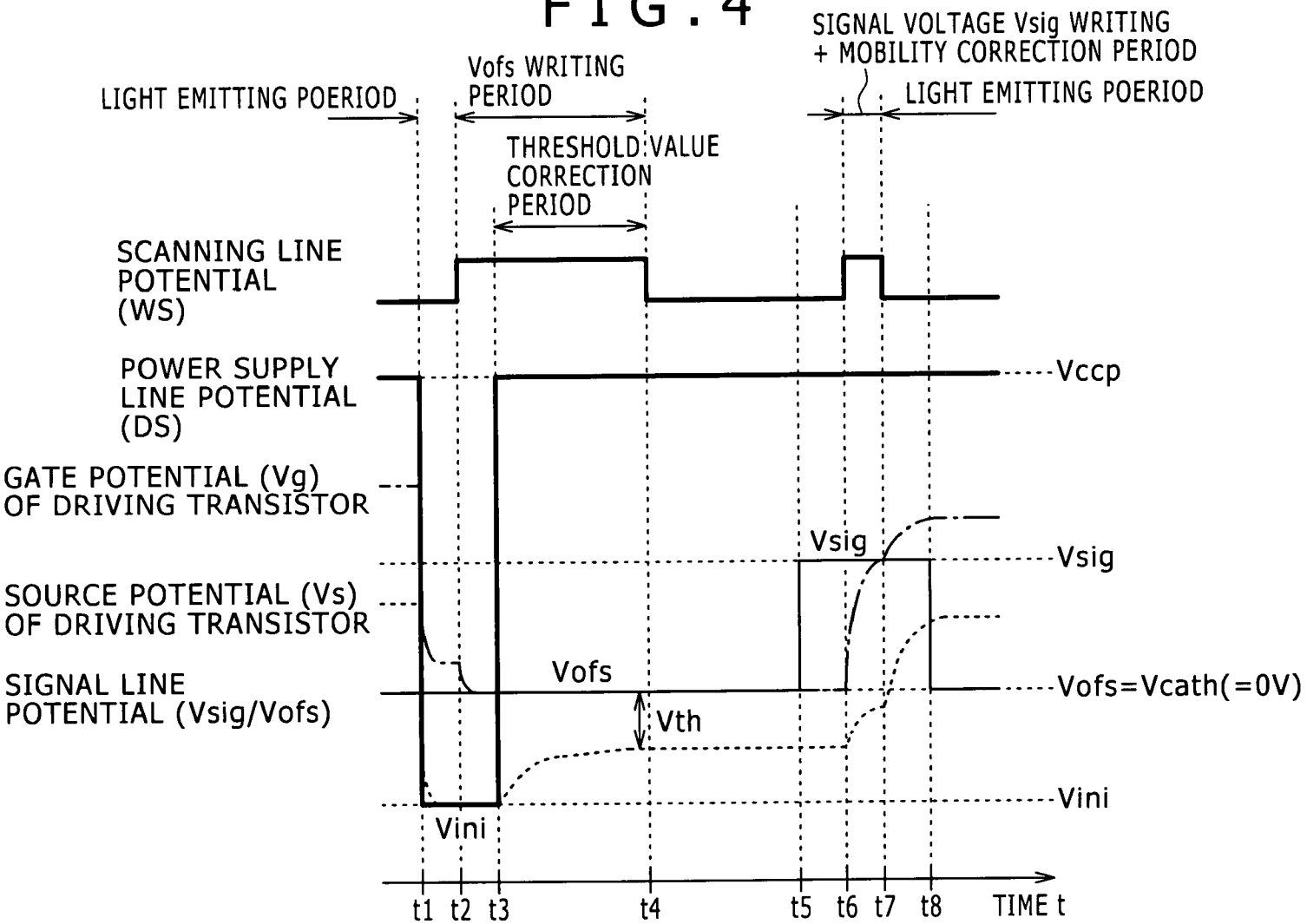
FIG. 4 is a timing waveform diagram illustrating operation of the organic EL display apparatus of FIG. 1 in an ideal state.

In the timing waveform diagram of FIG. 4, a variation of the potential or scanning signal WS of a scanning line 31 (31-1 to **31-*m*), a variation of the potential DS of a power supply line 32 (32-1 to 32-*m*), and variations of a gate potential Vg and a source potential Vs of the driving transistor 22**. Further, a waveform of the gate potential Vg is indicated by an alternate long and short dash line and a waveform of the source potential Vs is indicated by a dotted line so that they can be distinguished from each other readily.

<Light Emitting Period of the Preceding Frame>

In the timing waveform diagram of FIG. 4, a light emitting period of the organic EL element 21 in the preceding frame is defined prior to time t1. Within this light emitting period, the potential DS of the power supply line 32 is the first potential (hereinafter referred to as high potential) Vccp and the writing transistor 23 is in a non-conducting state.

Figure 5A:
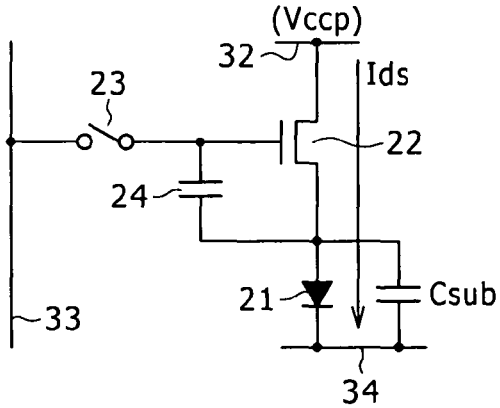
FIGS. 5A to 5D and 6A to 6D are circuit diagrams illustrating circuit operation of the organic EL display apparatus of FIG. 1.
Figure 5B:
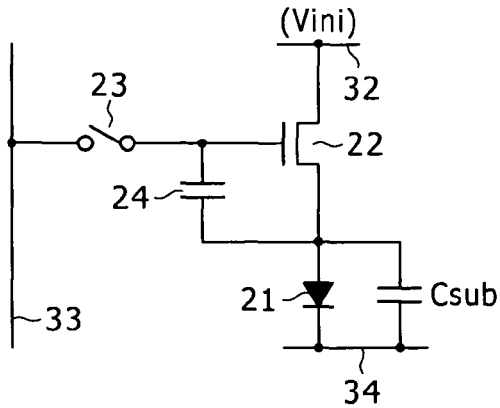

At this time, since the driving transistor 22 is set so as to operate in a saturation region, driving current or drain-source current Ids which depends upon the gate-source voltage Vgs of the driving transistor 22 is supplied from the power supply line 32 to the organic EL element 21 through the driving transistor 22 as seen from FIG. 5A. Consequently, the organic EL element 21 emits light with a luminance corresponding to the current value of the driving current Ids.

<Threshold Value Correction Preparation Period>

Then, when the time t1 comes, the line sequential scanning enters a new frame, that is, a current frame. Then, as seen from FIG. 5B, the potential DS of the power supply line 32 changes over from the high potential Vccp to the second power supply potential (hereinafter referred to as low potential) Vini which is sufficiently lower than Vofs−Vth with respect to the reference potential Vofs of the signal line 33.

Here, where the threshold voltage of the organic EL element 21 is represented by Vel and the potential of the common power supply line 34 is represented by Vcath, if the low potential Vini is set to Vini<Vel+Vcath, then since the source potential Vs of the driving transistor 22 becomes substantially equal to the low potential Vini, the organic EL element 21 is placed into a reversely biased state and stops the emission of light.

Figure 5C:
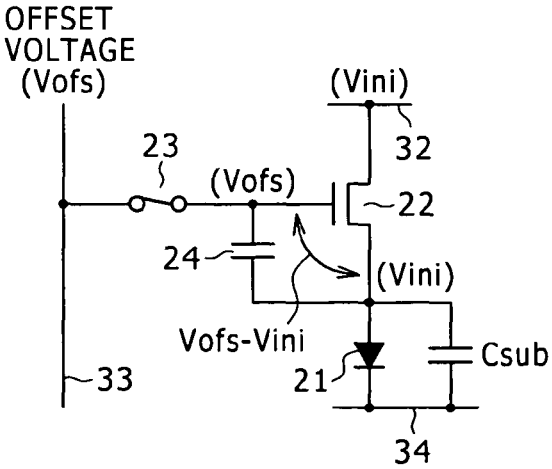

Then at time t2, the potential WS of the scanning line 31 changes from the low potential side to the high potential side, whereupon the writing transistor 23 is placed into a conducting state as seen from FIG. 5C. At this time, since the reference potential Vofs is supplied from the signal outputting circuit 60 to the signal line 33, the gate potential Vg of the driving transistor 22 becomes equal to the reference potential Vofs. Meanwhile, the source potential Vs of the driving transistor 22 remains the potential Vini which is sufficiently lower than the reference potential Vofs.

At this time, the gate-source voltage Vgs of the driving transistor 22 is Vofs−Vini. Here, if Vofs−Vini is not sufficiently higher than the threshold voltage Vth of the driving transistor 22, then since a threshold value correction operation hereinafter described cannot be carried out, it is necessary to establish the potential relationship of Vofs−Vini>Vth.

The process of fixing or settling the gate potential Vg and the source potential Vs of the driving transistor 22 to the reference potential Vofs and the low potential Vini, respectively, in this manner is a process for preparation before a threshold value correction process hereinafter described, that is, for threshold value correction preparation.

<Threshold Value Correction Period>

Figure 5D:
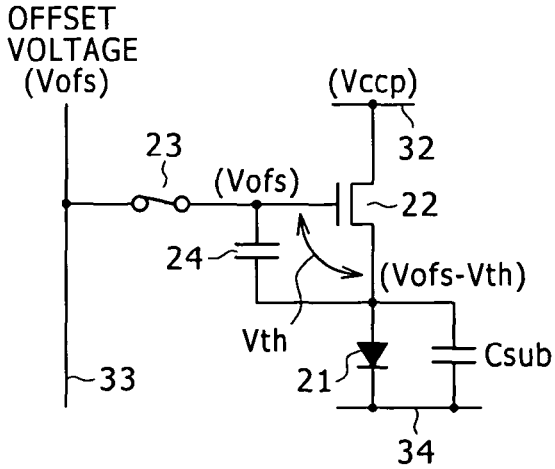

Then at time t3, the potential DS of the power supply line 32 changes over from the low potential Vini to the high potential Vccp as seen from FIG. 5D. Thereupon, the source potential Vs of the driving transistor 22 begins to rise toward a potential equal to the difference of the threshold voltage Vth of the driving transistor 22 from the gate potential Vg of the driving transistor 22 in a state wherein the gate potential Vg is maintained. Soon, the gate-source voltage Vgs of the driving transistor 22 converges to the threshold voltage Vth of the driving transistor 22, and a voltage corresponding to the threshold voltage Vth is held into the holding capacitor 24.

Here, for the convenience of description, a period within which the source potential Vs of the driving transistor 22 is changed, particularly, raised toward the potential equal to the difference of the threshold voltage Vth of the driving transistor 22 from the initialization voltage Vofs (=gate potential Vg) for the gate electrode of the driving transistor 22 with reference to the initialization voltage Vofs in a state wherein the gate potential Vg of the driving transistor is maintained, whereafter the gate-source voltage Vgs of the driving transistor 22 finally converged is detected and a voltage corresponding to the threshold voltage Vth is held into the holding capacitor 24 is called threshold value correction period.

It is to be noted that, in order to allow current to flow only to the holding capacitor 24 side without flowing to the organic EL element 21 side within the threshold value correction period, the potential Vcath of the common power supply line 34 is set so that the organic EL element 21 may exhibit a cutoff state.

Figure 6A:
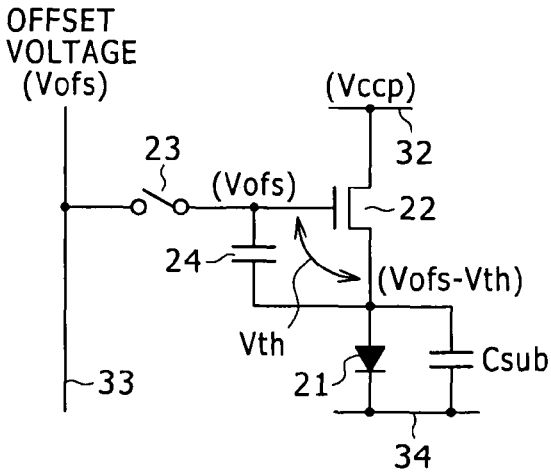

Then, at time t4, the potential WS of the scanning line 31 changes to the low potential side, and consequently, the writing transistor 23 is placed into a non-conducting state as seen in FIG. 6A. At this time, while the gate electrode of the driving transistor 22 enters a floating state because the gate electrode thereof is electrically disconnected from the signal line 33, since the gate-source voltage Vgs is equal to the threshold voltage Vth of the driving transistor 22, the driving transistor 22 is in a cutoff state. Accordingly, the drain-source current Ids does not flow to the driving transistor 22.

<Writing Period/Mobility Correction Periods

Figure 6B:
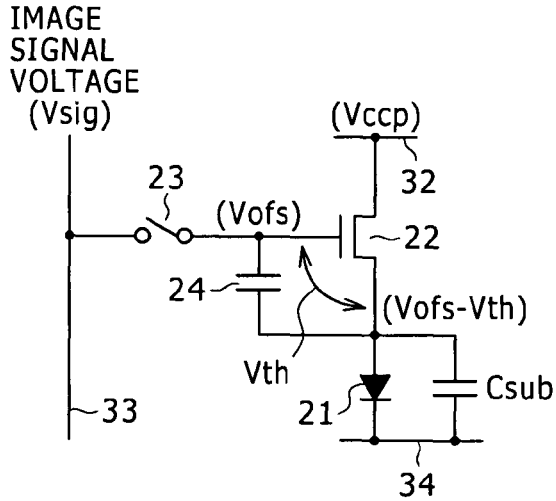
Figure 6C:
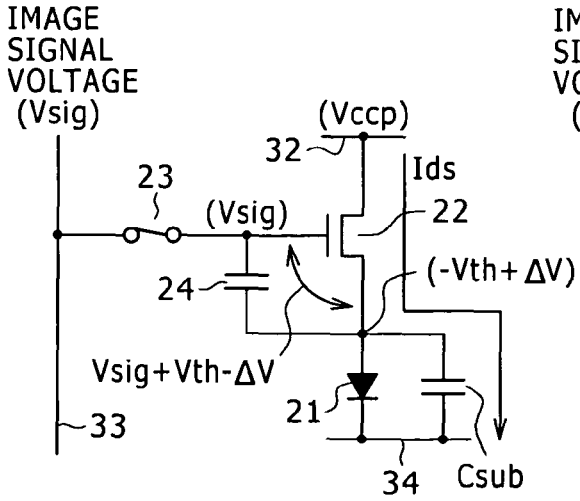

Then at time t5, the potential of the signal line 33 changes over from the reference potential Vofs to the signal voltage vsig of the image signal as seen from FIG. 6B. Then at time t6, the potential WS of the scanning line 31 changes to the high potential side, and consequently, the writing transistor 23 enters a conducting state to sample the signal voltage Vsig of the image signal and writes the sampled signal voltage Vsig into the pixel 20 as seen from FIG. 6C.

As a result of the writing of the signal voltage Vsig by the writing transistor 23, the gate potential Vg of the driving transistor 22 becomes equal to the signal voltage Vsig. Then, upon driving of the driving transistor 22 by the signal voltage Vsig of the image signal, the threshold voltage Vth of the driving transistor 22 is canceled by a voltage corresponding to the threshold voltage Vth held in the holding capacitor 24 to carry out threshold value correction. Details of the principle of threshold value correction are hereinafter described.

At this time, since the organic EL element 21 is in a cutoff state first, that is, in a high impedance state, current flowing from the power supply line 32 to the driving transistor 22 in response to the signal voltage Vsig of the image signal, that is, the drain-source current Ids, flows into the combined capacitor Csub connected in parallel to the organic EL element 21. Consequently, charging of the combined capacitor Csub is started.

By the charging of the combined capacitor Csub, the source potential Vs of the driving transistor 22 rises as time passes. At this time, the dispersion of the threshold voltage Vth of the driving transistor 22 has been compensated for already, and the drain-source current Ids of the driving transistor 22 relies upon the mobility μ of the driving transistor 22.

Here, if it is assumed that the writing gain, that is, the ratio of the holding voltage Vgs of the holding capacitor 24 with respect to the signal voltage Vsig of the image signal is 1 which is an ideal value, then as the source potential Vs of the driving transistor 22 rises to the potential of Vofs−Vth+ΔV, the gate-source voltage Vgs of the driving transistor 22 becomes Vsig−Vofs+Vth−ΔV.

In particular, the rise amount ΔV of the source potential Vs of the driving transistor 22 acts so as to be subtracted from the voltage (Vsig−Vofs+Vth) held in the holding capacitor 24, in other words, so as to discharge the accumulated charge of the holding capacitor 24, whereby negative feedback is applied. Accordingly, the rise amount ΔV of the source potential Vs is a feedback amount in the negative feedback.

By negatively feeding back the drain-source current Ids flowing through the driving transistor 22 to the gate input of the driving transistor 22, that is, to the gate-source voltage Vgs of the driving transistor 22 in this manner, mobility correction of canceling the dependency of the drain-source current Ids of the driving transistor 22 upon the mobility A, that is, of compensating for the dispersion for each pixel of the mobility μ, is carried out.

More particularly, since, as the signal voltage Vsig of the image signal rises, the drain-source current Ids increases, also the absolute value of the feedback amount or correction amount ΔV in the negative feedback increases. Accordingly, mobility correction in accordance with the emission light luminance level is carried out.

On the other hand, if the signal voltage Vsig of the image signal is fixed, then since, as the mobility μ of the driving transistor 22 increases, also the absolute value of the feedback amount ΔV in the negative feedback increases, the dispersion of the mobility μ for each pixel can be eliminated. Details of the principle of the mobility correction are hereinafter described.

<Light Emitting Period>

Figure 6D:
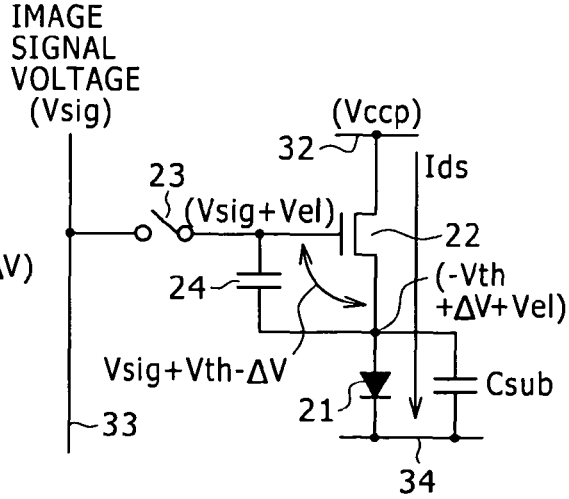

Then at time t7, the potential WS of the scanning line 31 changes to the low potential side, and thereupon, the writing transistor 23 is placed into a non-conducting state as seen in FIG. 6D. Consequently, the gate electrode of the driving transistor 22 is electrically disconnected from the signal line 33 and enters a floating state.

Here, when the gate electrode of the driving transistor 22 is in a floating state, since the holding capacitor 24 is connected between the gate and the source of the driving transistor 22, if the source potential Vs of the driving transistor 22 varies, then also the gate potential Vg of the driving transistor 22 varies in an interlocking relationship with, that is, following up, the variation of the source potential Vs. The operation of the gate potential Vg of the driving transistor 22 in this manner is bootstrap operation by the holding capacitor 24.

When the gate electrode of the driving transistor 22 is placed into a floating state and simultaneously the drain-source current Ids of the driving transistor 22 begins to flow through the organic EL element 21, the anode potential of the organic EL element 21 rises in response to the drain-source current Ids of the driving transistor 22.

Then, when the anode potential of the organic EL element 21 exceeds Vel+Vcath, the organic EL element 21 begins to emit light. The rise of the anode potential of the organic EL element 21 is a rise of the source potential Vs of the driving transistor 22. As the source potential Vs of the driving transistor 22 rises, also the gate potential Vg of the driving transistor 22 rises in an interlocking relationship by the bootstrap operation of the holding capacitor 24.

At this time, if it is assumed that the bootstrap gain is 1 which is an ideal value, then the rise amount of the gate potential Vg is equal to the rise amount of the source potential Vs. Therefore, the gate-source voltage Vgs of the driving transistor 22 is kept fixed at Vsig−Vofs+Vth−ΔV within the light emitting period. Then, at time t8, the potential of the signal line 33 changes over from the signal voltage Vsig to the offset voltage Vofs.

Principle of Threshold Value Correction

Here, the principle of threshold value correction of the driving transistor 22 is described. The driving transistor 22 operates as a constant current source because it is designed so as to operate in a saturation region. Consequently, fixed drain-source current or driving current Ids given by the following expression (1) is supplied from the driving transistor 22 to the organic EL element 21:

$$Ids=(1/2)\cdot\mu(W/L)Cox(Vgs-Vth)^2 \quad (1)$$

where W is the channel width of the driving transistor 22, L the channel length, and Cox the gate capacitance per unit area.

Figure 7:
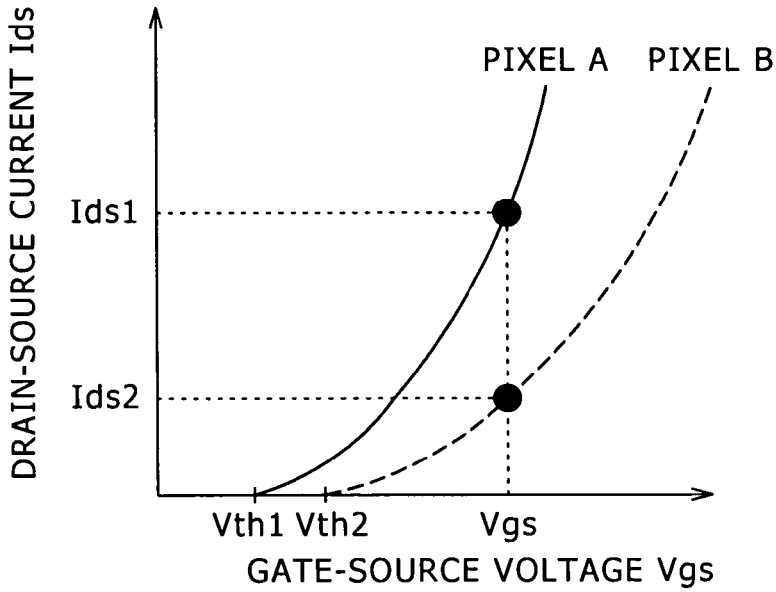
FIG. 7 is a characteristic diagram illustrating a subject of the organic EL display apparatus of FIG. 1 which arises from a dispersion of the threshold voltage of a driving transistor.

FIG. 7 illustrates a characteristic of the drain-source current Ids−gate-source voltage Vgs of the driving transistor 22.

As seen from the characteristic diagram of FIG. 7, if compensation for the dispersion of the threshold voltage Vth of the driving transistor 22 for each pixel is not carried out, then when the threshold voltage Vth is Vth1, the drain-source current Ids corresponding to the gate-source voltage Vgs becomes Ids1.

On the other hand, when the threshold voltage Vth is Vth2 (Vth2>Vth1), the drain-source current Ids corresponding to the same gate-source voltage Vgs is Ids2 (Ids2<Ids). In other words, if the threshold voltage Vth of the driving transistor 22 varies, then the drain-source current Ids varies even if the gate-source voltage Vgs is fixed.

On the other hand, in the pixel or pixel circuit 20 having the configuration described above, since the gate-source voltage Vgs of the driving transistor 22 upon light emission is Vsig−Vofs+Vth−ΔV, by substituting this into the expression (1), the drain-source current Ids is represented by the following expression (2):

$$Ids=(1/2)\cdot\mu(W/L)Cox(Vsig-Vofs-\Delta V)^2 \quad (2)$$

In particular, the item of the threshold voltage Vth of the driving transistor 22 is canceled, and the drain-source current Ids supplied from the driving transistor 22 to the organic EL element 21 does not rely upon the threshold voltage Vth of the driving transistor 22. As a result, even if the threshold voltage Vth of the driving transistor 22 is varied for each pixel by a dispersion of the fabrication process of the driving transistor 22 or by a secular change of the driving transistor 22, since the drain-source current Ids does not vary, the emission light luminance of the organic EL element 21 can be kept fixed.

Principle of Mobility Correction

Figure 8:
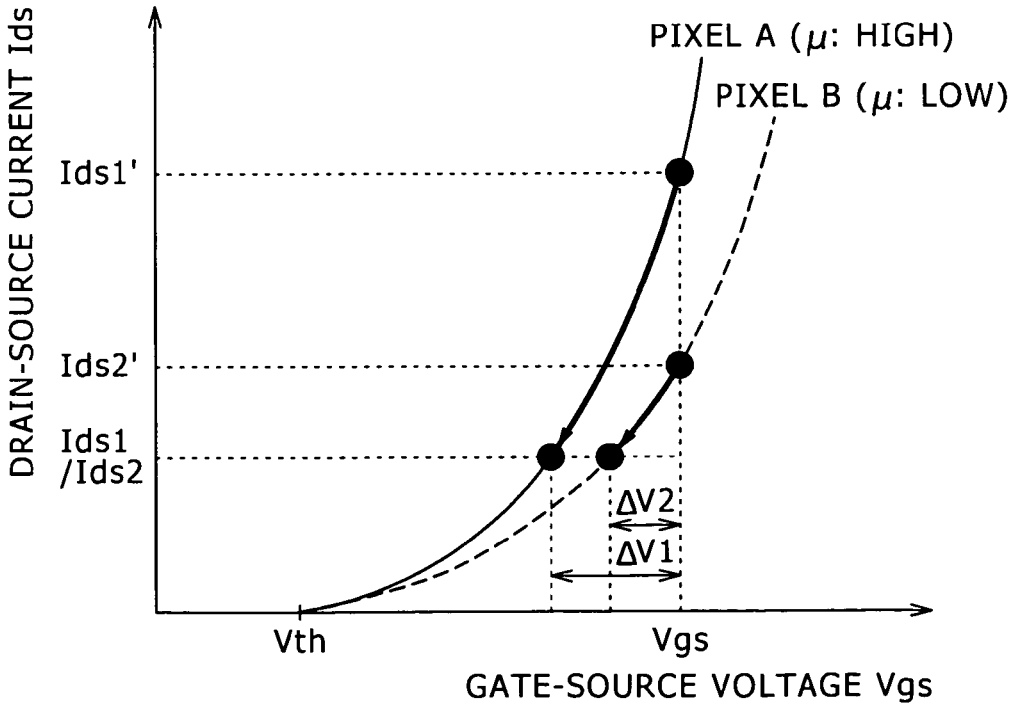
FIG. 8 is a characteristic diagram illustrating another subject of the organic EL display apparatus of FIG. 1 which arises from a dispersion of the mobility of a driving transistor.

Now, the principle of mobility correction of the driving transistor 22 is described. FIG. 8 shows characteristic curves of a pixel A wherein the mobility μ of the driving transistor 22 is relatively high and another pixel B wherein the mobility μ of the driving transistor 22 is relatively low for comparison. Where the driving transistor 22 is formed from a polycrystalline silicon thin film transistor, dispersion of the mobility μ between pixels cannot be avoided.

For example, where the signal potentials Vsig of the image signal having the same level are written into the two pixels A and B in a state wherein the pixels A and B have a dispersion in the mobility μ, if correction of the mobility μ is not carried out, then a great difference appears between drain-source current Ids1' flowing through the pixel A having the high mobility μ and drain-source current Ids2' flowing through the pixel B having the low mobility μ. If a great difference is caused to appear in the drain-source current Ids by the dispersion of the mobility μ for each pixel in this manner, then the uniformity of the screen image is damaged.

Here, as can be apparent from the transistor characteristic expression (1) given hereinabove, as the mobility μ increases, the drain-source current Ids increases. Accordingly, as the mobility μ increases, the feedback amount ΔV in the negative feedback increases. As illustrated in FIG. 8, the feedback amount ΔV1 of the pixel A having the high mobility μ is greater than the feedback amount ΔV2 of the pixel B having the low mobility μ.

Therefore, by negatively feeding back the drain-source current Ids of the driving transistor 22 to the signal voltage Vsig side of the image signal by the mobility correction operation, as the mobility μ increases, the amount of the negative feedback increases, and consequently, the dispersion of the mobility μ for each pixel can be suppressed.

In particular, if correction of the feedback amount ΔV1 is carried out for the pixel A having the high mobility μ, then the drain-source current Ids drops by a great amount from Ids1' to Ids1. On the other hand, since the feedback amount ΔV2 of the pixel B having the low mobility μ is small, the drain-source current Ids drops from Ids2' to Ids2. As a result, the drain-source current Ids1 of the pixel A and the drain-source current Ids2 of the pixel B become substantially equal to each other, and therefore, the dispersion of the mobility μ for each pixel is compensated for.

In summary, where the pixel A and the pixel B are different in mobility μ, the feedback amount ΔV1 of the pixel A having the high mobility μ is greater than the feedback amount ΔV2 of the pixel B having the low mobility μ. In short, as the mobility μ increases, the feedback amount ΔV increases and the reduction amount of the drain-source current Ids increases.

Accordingly, by negatively feeding back the drain-source current Ids of the driving transistor 22 to the gate electrode side of the driving transistor 22 to which the signal voltage Vsig of the image signal is applied, the current values of the drain-source current Ids of pixels which are different in mobility μ are uniformized. As a result, the dispersion of the mobility μ for each pixel can be compensated for. In other words, the process of negatively feeding back the current flowing through the driving transistor 22, that is, the drain-source current Ids, to the gate electrode side of the driving transistor 22 is the mobility correction process.

Here, a relationship between the signal potential or sampling potential Vsig of the image signal and the drain-source current Ids of the driving transistor 22 which depends upon whether or not threshold value correction or mobility correction is carried out in the pixel or pixel circuit 20 shown in FIG. 2 is described with reference to FIGS. 9A to 9C.

Figure 9A:
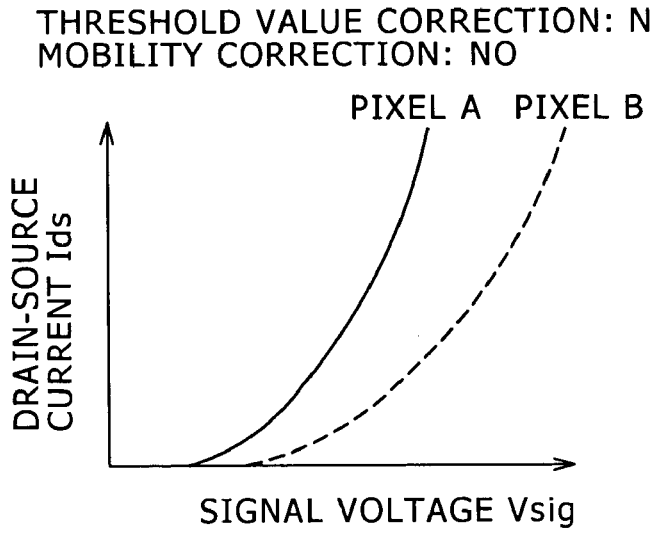
FIGS. 9A to 9C are characteristic diagrams illustrating relationships between a signal voltage of an image signal and drain-source current of the driving transistor which depend upon whether or not threshold value correction and/or mobility correction is carried out.
Figure 9B:
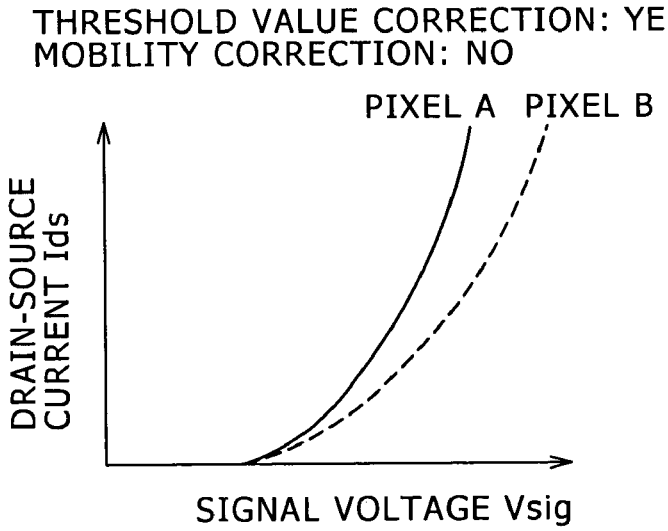
Figure 9C:
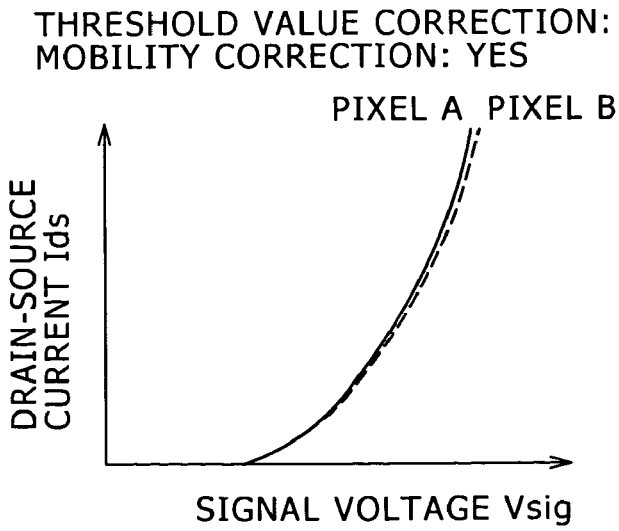

Referring to FIGS. 9A to 9C, FIG. 9A illustrates the relationship where none of the threshold value correction and the mobility correction is carried out; FIG. 9B illustrates the relationship where only the threshold value correction is carried out while the mobility correction is not carried out; and FIG. 9C illustrates the relationship where both of the threshold value correction and the mobility correction are carried out. Where none of the threshold value correction and the mobility correction is carried out as seen in FIG. 9A, a great difference in the drain-source current Ids originating from the dispersion in the threshold voltage Vth and the mobility μ for each of the pixels A and B appears between the pixels A and B.

In contrast, where only the threshold value correction is carried out, although the dispersion of the drain-source current Ids can be reduced to some degree by the threshold value correction, the difference in drain-source current Ids between the pixels A and B originating from the dispersion in mobility μ between the pixels A and B remains.

Then, where both of the threshold value correction and the mobility correction are carried out, the difference in drain-source current Ids between the pixels A and B originating from the dispersion in threshold voltage Vth and mobility μ for each of the pixels A and B can be almost eliminated as seen in FIG. 9C. Therefore, a luminance dispersion of the organic EL element 21 does not appear in any gradation, and a display image of good picture quality can be obtained.

Since the pixel 20 shown in FIG. 2 includes the bootstrap function by the holding capacitor 24 described above in addition to the correction functions including the threshold value correction and mobility correction functions, the following working effects can be anticipated.

In particular, even if the I-V characteristic of the organic EL element 21 undergoes secular change and this varies the source potential Vs of the driving transistor 22, since the gate-source voltage Vgs of the driving transistor 22 can be kept fixed by the bootstrap operation by the holding capacitor 24, the current flowing through the organic EL element 21 does not vary but is fixed. Accordingly, since the emission light luminance of the organic EL element 21 is kept fixed, even if the I-V characteristic of the organic EL element 21 undergoes secular change, image display free from luminance deterioration by such secular change can be implemented.

Problems in an Actual Operation State

Now, circuit operation of the organic EL display apparatus 10 in an actual operation state is described with reference to a timing waveform diagram of FIG. 10.

It is to be noted that the circuit operation in an actual operation state described below relates to an example wherein a threshold value correction period within which constant current is supplied to the driving transistor 22 to detect the gate-source voltage Vgs of the driving transistor 22 is provided, in addition to one horizontal scanning period (1 H) within which mobility correction and signal writing are carried out, in a plurality of horizontal scanning periods preceding to the 1 H period, in the present example, in a preceding 1 H period, and consequently over a totaling 2 H period.

Figure 10:
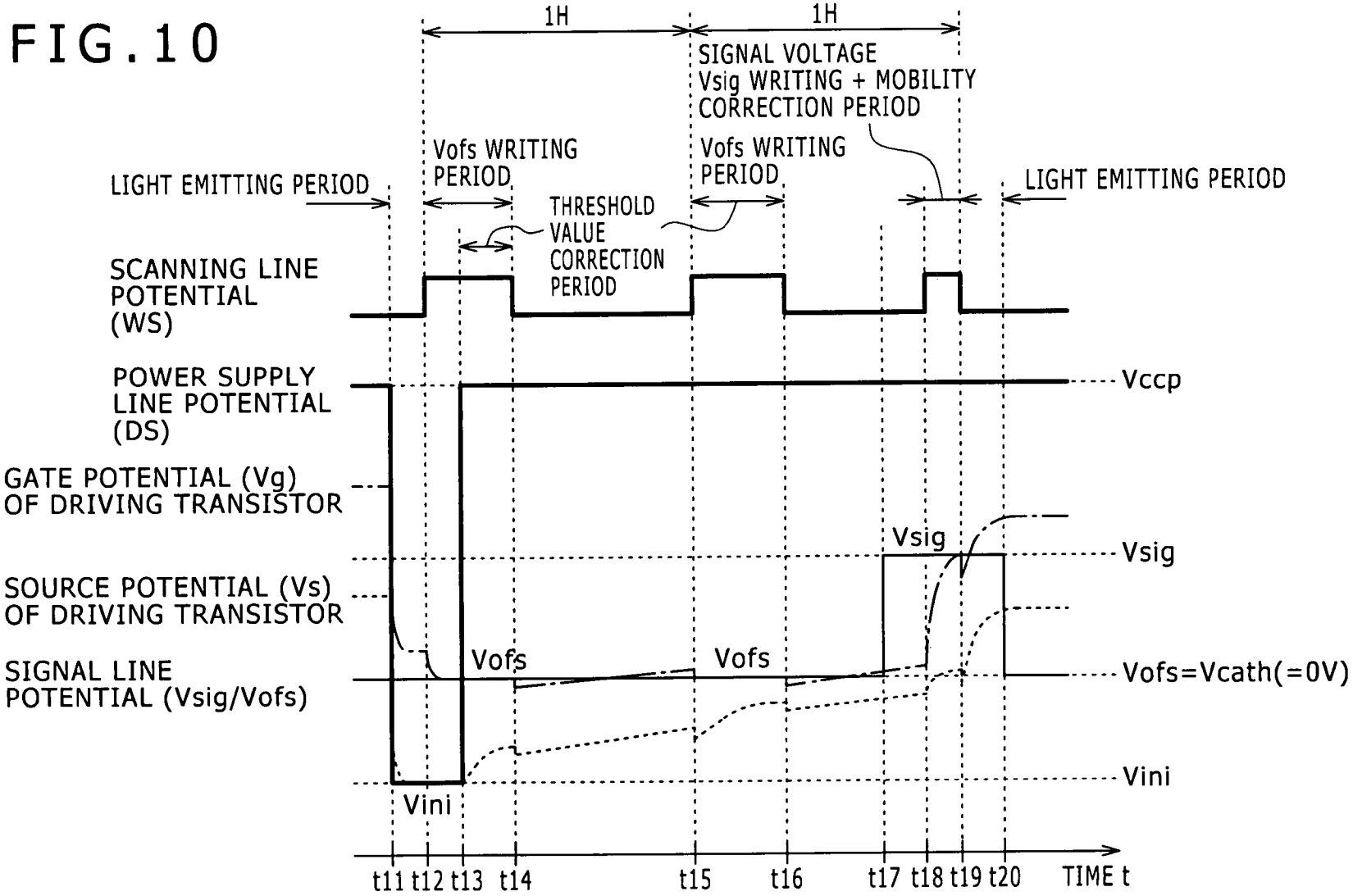
FIG. 10 is a timing waveform diagram illustrating operation in actual operation of the organic EL display apparatus of FIG. 1.

In particular, where the threshold value correction process is executed twice over a 2 H period, as seen from a timing waveform diagram of FIG. 10, the first-time threshold value correction process is carried out within a period of t12 to t14 within a 1 H period of a pixel row prior by a 1 H period, that is, by a one-row distance, to a 1 H period within which mobility correction and signal writing are carried out. On the other hand, the second-time threshold value correction process is carried out within another period of t15 to t16 within the 1 H period within which mobility correction and signal writing are carried out.

Even if the time allocated to a 1 H period is decreased by increase of pixels by refinement by providing a threshold value correction period over a 1 H period within which mobility correction and signal writing are carried out and plural H periods preceding to the 1 H period in this manner, it is possible to assure a sufficient period of time as the threshold value correction period. Therefore, it is possible to detect the threshold voltage Vth of the driving transistor 22 with certainty and hold the threshold voltage Vth into the holding capacitor 24 and thereby to carry out the threshold value correction process with certainty.

In circuit operation, timings t11, t13 and t17 to t20 in the timing waveform diagram of FIG. 10 correspond to timings t1, t3 and t5 to t8 of the timing waveform diagram of FIG. 4, respectively, and timings t12 and t15 and timings t14 and t16 of the timing waveform diagram of FIG. 10 correspond to timings t2 and t4 of the timing waveform diagram of FIG. 4, respectively.

Incidentally, if, in the ideal operation state described above, the potential WS of the scanning line 31 changes to the low potential side and the writing transistor 23 enters a non-conducting state at time t4, then the gate electrode of the driving transistor 22 is electrically disconnected from the signal line 33 and enters a floating state. However, since the gate-source voltage Vgs is equal to the threshold voltage Vth of the driving transistor 22, the driving transistor 22 is in a cutoff state and the drain-source current Ids does not flow through the driving transistor 22.

However, this is operation in the ideal operation state described above to the end. In actual operation, when the threshold value correction operation for the first and second times ends and the potential WS of the scanning line 31 changes to the low potential side at time t14 and time t16 to place the writing transistor 23 into a non-conducting state to place the gate electrode of the driving transistor 22 into a floating state, since actually the driving transistor 22 suffers from current leak, leak current flows through the driving transistor 22 although it is little. Consequently, the source potential Vs of the driving transistor 22 gradually rises, and also the gate potential Vg gradually rises in an interlocking relationship by a bootstrap operation.

In addition, since the driving transistors 22 of the pixels 20 have a dispersion in characteristic and also the leak current flowing through the driving transistor 22 differs among different ones of the driving transistors 22, the variation amounts of the source potential Vs and the gate potential Vg which vary by leak current flowing through the driving transistor 22 differ among different ones of the pixels 20.

If the source potential Vs and the gate potential Vg of the driving transistor 22 rise by leak current after the threshold value correction process comes to an end, then the source potential Vs at a point of time when the writing period of the signal voltage Vsig comes to an end is not necessarily fixed but differs among different ones of the pixels 20. Therefore, at a point of time at which the writing period comes to an end, the gate-source voltage Vgs of the driving transistor 22 disperses among the pixels 20, and therefore, even if the same signal voltage Vsig is applied to the gate electrode of the driving transistors 22 in different ones of the pixels, a difference in emission light luminance of the organic EL element 21 appears among different ones of the pixels.

In this manner, even if the threshold value correction process for improving the display quality is executed, since both of the gate potential Vg and the source potential Vs of the driving transistor 22 rise by current leak of the driving transistor 22 and a difference in emission light luminance of the organic EL element 21 appears among different ones of the pixels thereby, the threshold value correction process becomes incomplete or is carried out excessively. In other words, a desired threshold value correction process cannot be executed, and consequently, an effect of improvement of the display quality by the threshold value correction process cannot be obtained.

Characteristic Portions of the Embodiment

In the present embodiment as the reference potential Vofs, three different reference potentials including a first reference potential Vofs1 to be used as a reference for the signal voltage Vsig of the image signal according to luminance information, for example, a potential corresponding to the black level, a second reference potential Vofs2 lower then the first reference potential Vofs1, and a third reference potential Vofs3 equal to or higher than the first reference potential Vofs1.

The three different reference potentials Vofs1, Vofs2 and Vofs3 are supplied to the pixels 20 of a selected row through a signal line 33 at a suitable timing in place of the signal voltage Vsig from the signal outputting circuit 60 (refer to FIG. 1).

Signal Outputting Circuit

Figure 11:
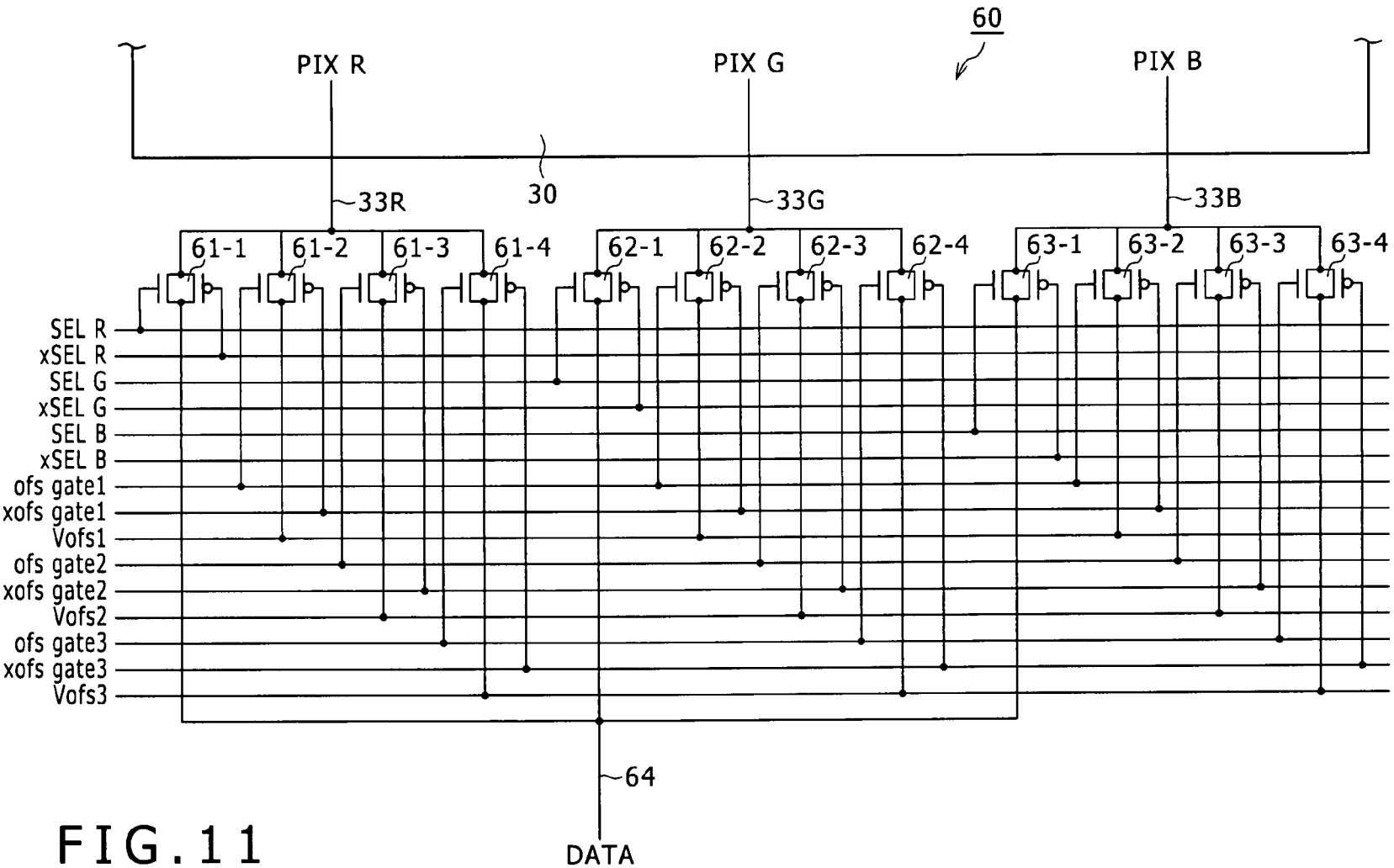
FIG. 11 is a circuit diagram showing an example of a configuration of a signal outputting circuit of the organic EL display apparatus of FIG. 1.

FIG. 11 shows an example of a configuration of the signal outputting circuit 60. In FIG. 11, a circuit configuration only of circuit portions corresponding to three sub pixels for R, G and B which form one pixel in an organic EL display apparatus for color display is shown for simplified illustration. Further, from among the signal lines 33-1 to **33-*n*, only three ones which correspond to the sub pixels for R, G and B are shown as signal lines 33R, 33G and 33**B.

Referring to FIG. 11, output terminals of four selection switches 61-1 to 61-4 are connected commonly to one end of the signal line 33R. Output terminals of four selection switches 62-1 to 62-4 are connected commonly to one end of the signal line 33G. Output terminals of four selection switches 63-1 to 63-4 are connected commonly to one end of the signal line 33B. The selection switches 61-1 to 61-4, 62-1 to 62-4 and 63-1 to 63-4 are analog switches each formed, for example, from a CMOS (Complementary Metal Oxide Semiconductor) transmission gate, but may have any other form.

An image signal is supplied from a data line 64 to input terminals of the selection switches 61-1, 62-1 and 63-1. The image signal is a time series signal by which image signals of R, G and B are supplied successively in order. The selection switch 61-1 is driven by switch control signals SEL R and xSEL R of the opposite phases to each other, which are rendered active at a timing of the image signal of R from within the time series signal to select and output the image signal of R to the signal line 33R.

The selection switch 62-1 is driven by switch control signals SEL G and xSEL G of the opposite phases to each other, which are rendered active at a timing of the image signal of G from within the time series signal to select and output the image signal of G to the signal line 33G. The selection switch 63-1 is driven by switch control signals SEL B and xSEL B of the opposite phases to each other, which are rendered active at a timing of the image signal of B from within the time series signal to select and output the image signal of B to the signal line 33B.

The first reference potential Vofs1 is applied to input terminals of the selection switches 61-2, 62-2 and 63-2. The selection switches 61-2, 62-2 and 63-2 are driven by switch control signals ofs gate1 and xofs gate1 of the opposite phases to each other to selectively output the first reference potential Vofs1 to the signal lines 33R, 33G and 33B, respectively.

The second reference potential Vofs2 is applied to input terminals of the selection switches 61-3, 62-3 and 63-3. The selection switches 61-3, 62-3 and 63-3 are driven by switch control signals ofs gate2 and xofs gate2 of the opposite phases to each other to selectively output the second reference potential Vofs2 to the signal lines 33R, 33G and 33B, respectively.

The third reference potential Vofs3 is applied to input terminals of the selection switches 61-4, 62-4 and 63-4. The selection switches 61-4, 62-4 and 63-4 are driven by switch control signals ofs gate3 and xofs gate3 of the opposite phases to each other to selectively output the third reference potential Vofs3 to the signal lines 33R, 33G and 33B, respectively.

Here, the image signal is supplied from a driver IC or signal production section not shown to the signal outputting circuit 60. The reference potentials Vofs1, Vofs2 and Vofs3 are supplied from a reference potential production section not shown to the signal outputting circuit 60. Further, the switch control signals SEL R, XSEL R, SEL G, XSEL G, SEL B, and XSEL B and the switch control signals ofs gate1 and xofs gate1, ofs gate2, xofs gate2, ofs gate3 and xofs gate3 are supplied from a timing generation section not shown to the signal outputting circuit 60.

The timings at which the switch control signals SEL R, xSEL R, SEL G, XSEL G, SEL B, and XSEL B are rendered active are in synchronism with the timings of the image signals of R, G and B of the time series signal. The timings at which the switch control signals ofs gate1, xofs gate1, ofs gate2, xofs gate2, ofs gate3 and xofs gate3 are rendered active are hereinafter described.

As described hereinabove, the signal outputting circuit 60 according to the present embodiment is configured adopting a time-division driving system or selector driving system wherein a plurality of signal lines, in the present embodiment, the three signal lines 33R, 33G and 33B corresponding to R, G and B, are connected to the one data line 64 through the selection switches 61-1, 62-1 and 63-1 such that the signal potentials of image signals of R, G and B supplied in a time series through the data line 64 are time-divisionally supplied to the three signal lines 33R, 33G and 33B.

Circuit Operation of the Embodiment

Now, circuit operation of the present embodiment wherein the three reference potentials Vofs1, Vof2 and Vofs3 are used as the reference potential Vofs is described with reference to a timing waveform diagram of FIG. 12.

Figure 12:
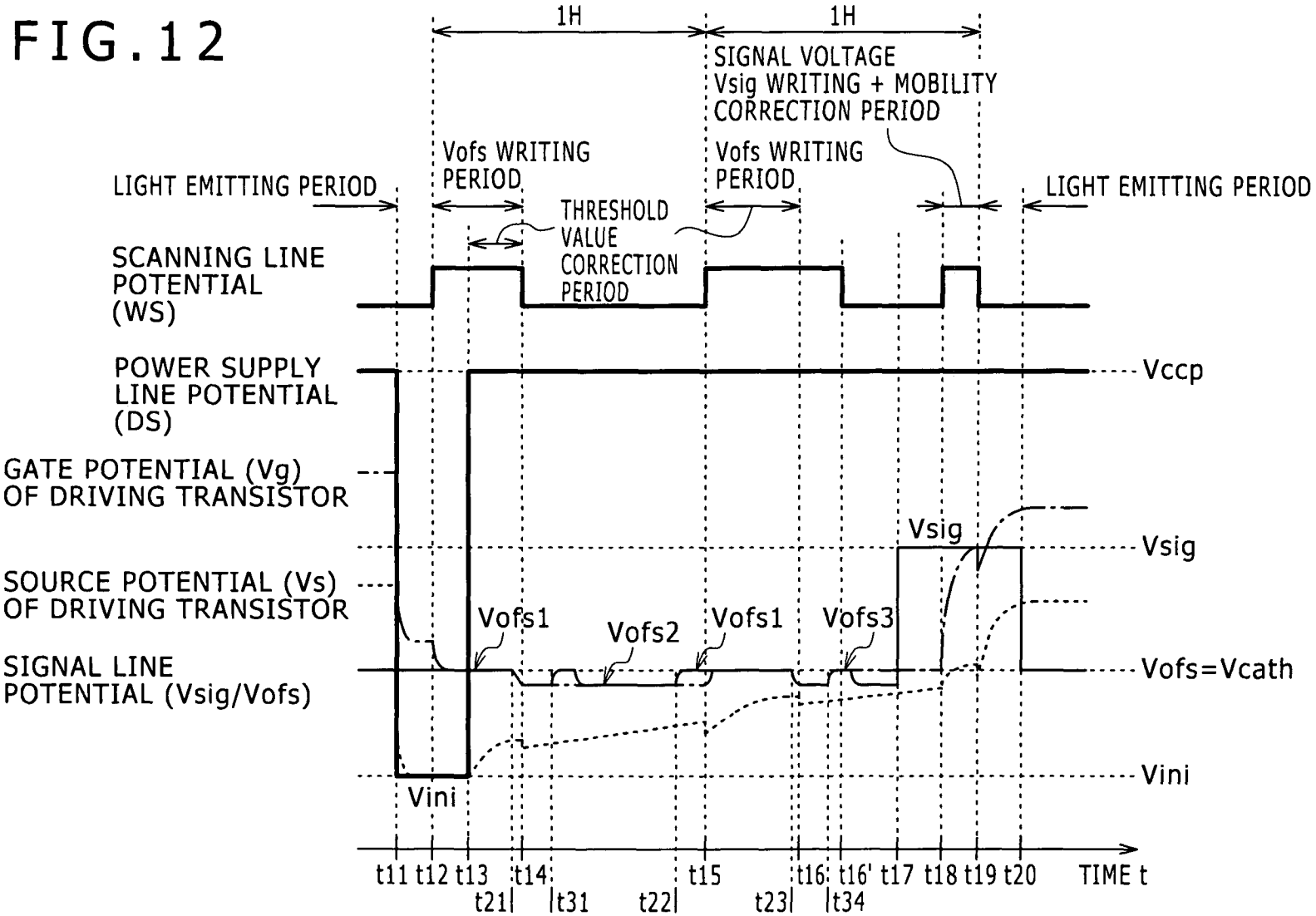
FIG. 12 is a timing waveform diagram illustrating operation of an organic EL display apparatus according to an embodiment of the present invention.

Also in the timing waveform diagram of FIG. 12, a variation of the potential WS of a scanning line 31, a variation of the potential DS of a power supply line 32, and variations of a gate potential Vg and a source potential Vs of the driving transistor 22 similarly as in the case of the timing waveform diagrams of FIGS. 4 and 10. Further, a waveform of the gate potential Vg is indicated by an alternate long and short dash line and a waveform of the source potential is indicated by a dotted line similarly.

Further, also in the circuit operation according to the present embodiment, the threshold value correction period within which the dispersion of the threshold voltage Vth of the driving transistor 22 for each of the pixels is to be corrected is provided, in addition to one horizontal scanning period (1 H) within which mobility correction and signal writing are carried out, in a plurality of horizontal scanning periods preceding to the 1 H period, in the present example, in a preceding 1 H period, and consequently over a totaling 2 H period.

In the circuit operation of the present embodiment, the reference potential Vofs to be outputted from the signal outputting circuit 60 is changed over from the first reference potential Vofs1 to the second reference potential Vofs2, which is lower than the first reference potential Vofs1, at time t21 immediately prior to the end of a first-time threshold value correction period (t12 to t14) within the threshold value correction period. The timing t21 at which the reference potential Vofs is changed over from the first reference potential Vofs1 to the second reference potential Vofs2 is a timing at which the switch control signals ofs gate1 and xofs gate1 are rendered inactive and the switch control signals ofs gate2 and xofs gate2 are rendered active.

By changing over the reference potential Vofs from the first reference potential Vofs1 to the lower second reference potential Vofs2 at a timing immediately prior to the end of the first-time threshold value correction period, the gate potential Vg of the driving transistor 22 drops, and consequently, the gate-source voltage Vgs of the driving transistor 22 becomes lower than a voltage corresponding to the threshold voltage Vth of the driving transistor 22. Accordingly, the driving transistor 22 is placed into a non-conducting state with certainty.

In particular, immediately before, in a state wherein the potential DS of the power supply line 32 is kept at the high potential Vccp, the potential WS of the scanning line 31 is changed from the high potential side to the low potential side to place the writing transistor 23 into a non-conducting state, the reference potential Vofs to be outputted from the signal outputting circuit 60 is changed over from the first reference potential Vofs1 to the second reference potential Vofs2 which is lower than the first reference potential Vofs1. Here, the second reference potential Vofs2 is set to a potential with which the gate-source voltage Vgs of the driving transistor 22 becomes lower than the threshold voltage Vth of the driving transistor 22.

In particular, immediately prior to the end of the first-time threshold value correction period, the first reference potential Vofs1 to be applied from the signal line 33 to the gate electrode of the driving transistor 22 through the writing transistor 23 is changed over to the second reference potential Vofs2 with which the gate-source voltage Vgs of the driving transistor 22 becomes lower than the threshold voltage Vth of the driving transistor 22. Consequently, the gate-source voltage Vgs of the driving transistor 22 becomes lower than the threshold voltage Vth of the driving transistor 22, and therefore, the driving transistor 22 is placed into a non-conducting state with certainty.

Thereafter, at time t22 before a second-time threshold value correction period is entered, the reference potential Vofs to be outputted from the signal outputting circuit 60 is changed over from the second reference potential Vofs2 back to the first reference potential Vofs1 to carry out the second-time threshold correction operation. The timing t22 at which the reference potential Vofs is changed over from the second reference potential Vofs2 to the first reference potential Vofs1 is a timing at which the switch control signals ofs gate1 and xofs gate1 are rendered active and the switch control signals ofs gate2 and xofs gate2 are rendered inactive.

Also within the second-time threshold value correction period, at time t23 within the threshold value correction period, the reference potential Vofs to be outputted from the signal outputting circuit 60 is changed over from the first reference potential Vofs1 to the second reference potential Vofs2 which is lower than the first reference potential Vofs1. The timing t23 at which the reference potential Vofs is changed over from the first reference potential Vofs1 to the second reference potential Vofs2 is a timing at which the switch control signals ofs gate1 and xofs gate1 are rendered inactive and the switch control signals ofs gate2 and xofs gate2 are rendered active in FIG. 11.

By changing over the reference potential Vofs from the first reference potential Vofs1 to the second reference potential Vofs2 which is lower than the first reference potential Vofs1 within the second-time threshold value correction period, the gate potential Vg of the driving transistor 22 drops similarly as in the operation immediately prior to the end of the first-time threshold value correction period. Consequently, the gate-source voltage Vgs of the driving transistor 22 drops to be lower than a potential corresponding to the threshold voltage Vth of the driving transistor 22, and therefore, the driving transistor 22 is placed into a non-conducting state with certainty.

By changing over the reference potential Vofs from the first reference potential Vofs1 to the lower second reference potential Vofs2 to place the driving transistor 22 into a non-conducting state with certainty within the first- and second-time threshold value correction periods in this manner, the threshold value correction periods end. Thus, when the gate electrode of the driving transistor 22 is placed into a floating state by the placement of the writing transistor 23 into a non-conducting state, appearance of current leak from the driving transistor 22 can be suppressed.

Consequently, since no leak current flows to the driving transistor 22 within a period within which the gate electrode of the driving transistor 22 is in a floating state, the source potential Vs of the driving transistor 22 does not vary. Accordingly, since the difference in emission light luminance between pixels arising from a dispersion of leak current of the driving transistor 22 can be suppressed, a desired threshold value correction process can be executed without suffering from such a situation that the threshold value correction process becomes incomplete or becomes excessive, and an effect of improvement of the display quality by the threshold value correction process can be achieved sufficiently.

On the other hand, although a writing process of the signal voltage Vsig including a mobility correction process is entered at time t17 after the last-time, in the present example, second-time, threshold value correction process ends, since the potential of the signal line 33 has been changed over from the first reference potential Vofs1 to the second reference potential Vofs2 within the second-time threshold value correction period, the signal outputting circuit 60 writes the signal voltage Vsig of the image signal from the second reference potential Vofs2 into the signal line 33.

In particular, the driver IC not shown which supplies the image signal to the signal outputting circuit 60 must write the signal voltage Vsig superfluously by a voltage corresponding to the potential difference of Vofs1−Vofs2 in comparison with that in an alternative case wherein changeover of the reference potential Vofs from the first reference potential Vofs1 to the second reference potential Vofs2 is not carried out. Since this signifies that the voltage range handled by the driver IC expands, this is disadvantageous from the point of view of the specifications of the driver IC because an IC for exclusive use must be produced. Further, this is not preferable because also the power consumption of the driver IC increases.

Further, if the voltage amplitude when the signal voltage Vsig is to be written expands, then the time until writing of the signal voltage Vsig by the writing transistor 23 is completed becomes longer. In the writing process of the signal voltage Vsig, also mobility correction is carried out simultaneously. Thus, if the mobility correction period is excessively long, then the mobility correction is carried out excessively before the signal writing comes to an end, resulting in excessive correction. Therefore, the writing process itself of the signal voltage Vsig is preferably carried out at a speed as high as possible.

Therefore, in the present embodiment, after the signal outputting circuit 60 changes over the reference potential Vofs from the first reference potential Vofs1 to the second reference potential Vofs2 at time t23, it changes over the reference potential Vofs from the second reference potential Vofs2 to a third reference potential Vofs3 at time t24 before the changeover from the reference potential Vofs to the signal voltage Vsig of the image signal at time t17.

The third reference potential Vofs3 is set to a potential substantially equal to or higher than the first reference potential Vofs1 or approximately one half the white level which is the maximum amplitude level of the signal voltage Vsig of the image signal. The third reference potential Vofs3 must be sampled in place of the second reference potential Vofs2 and written into the gate electrode of the driving transistor 22 by the writing transistor 23.

To this end, it is necessary to set the high potential period (t15 to t16') of the potential WS of the scanning line 31 for carrying out the second-time threshold value correction period to a longer period than the high potential period (t12 to t14=t15 to t16) in the first-time threshold value correction process. In particular, the timing t16' at which the potential WS of the scanning line 31 changes from the high potential to the low potential is set so as to be later than the timing t24 at which the reference potential Vofs is changed over from the second reference potential Vofs2 to the third reference potential Vofs3. By this, only the gate potential Vg of the driving transistor 22 immediately prior to writing of the signal voltage Vsig can be set high.

By settling the gate potential Vg of the driving transistor 22 to the second reference potential Vofs2 lower than the first reference potential Vofs1 after the end of the last-time threshold value correction process and then changing over the reference potential Vofs from the second reference potential Vofs2 to the third reference potential Vofs3 higher than the second reference potential Vofs2, whereafter the third reference potential Vofs3 is maintained till immediately prior to writing of the signal voltage Vsig in this manner, upon writing of the signal voltage Vsig into the signal line 33 by the signal outputting circuit 60, the signal voltage Vsig may be written not from the second reference potential Vofs2 but from the third reference potential Vofs3 higher than the second reference potential Vofs2, more particularly, from a potential substantially equal to or higher than the first reference potential Vofs1. Therefore, the processes for writing of the signal voltage Vsig and mobility correction can be carried out stably.

Here, while the effect described above provided by setting of the third reference potential Vofs3 to a potential substantially equal to the first reference potential Vofs1 to change over the reference potential Vofs from the first reference potential Vofs1 to the second reference potential Vofs2 is achieved, the processes for signal writing and mobility correction can be carried out stably similarly as in an alternative case wherein the reference potential Vofs is not changed over from the first reference potential Vofs1 to the second reference potential Vofs2. Although the stability degrades, even if the third reference potential Vofs3 is lower than the first reference potential Vofs1, if it is higher than the second reference potential Vofs2, then an adequate working effect can be achieved.

Further, for example, if the gate potential of the driving transistor 22 drops due to coupling at a falling edge of the potential WS of the scanning line 31 from the high potential to the low potential, then the third reference potential Vofs3 is preferably set to a potential higher than the first reference potential Vofs1. Where the third reference potential Vofs3 is set to a potential higher than the first reference potential Vofs1, the voltage amplitude of the signal voltage Vsig upon writing into the scanning line 31 by the signal outputting circuit 60 can be suppressed.

Particularly if the third reference potential Vofs3 is set to a potential substantially equal to one half the maximum amplitude level of the signal voltage Vsig of the image signal, then when the signal voltage Vsig is written into the scanning line 31 from the signal outputting circuit 60, the voltage amplitude becomes approximately equal to that upon writing not only when the maximum amplitude level is written but also when the minimum amplitude level is written. Consequently, the writing process of the signal voltage Vsig can be carried out rapidly, and the processes for writing of the signal voltage Vsig and mobility correction can be carried out stably.

Incidentally, as seen from the timing waveform diagram of FIG. 12, also at time t31 before the reference potential Vofs is changed over from the second reference potential Vofs2 back to the first reference potential Vofs1 at time t22 after the reference potential Vofs is changed over from the first reference potential Vofs1 to the second reference potential Vofs2 at time t21, the reference potential Vofs is changed over from the second reference potential Vofs2 to the third reference potential Vofs3. However, this changeover of the reference potential Vofs is intended to achieve a working effect by the third reference potential Vofs3 for the immediately preceding pixel row.

It is to be noted that, while, in the circuit operation according the present embodiment described above, the threshold value correction period within which the dispersion of the threshold voltage Vth of the driving transistor 22 for each pixel is compensated for is provided over a plurality of horizontal periods preceding to a 1 H period within which mobility correction and signal writing are carried out and the threshold value correction process is executed divisionally by a plural number of times, the present invention is not limited to this. The present invention can be applied also where the threshold value correction process is executed only once within a 1 H period within which the processes for mobility correction and signal writing are carried out.

Modifications

While, in the embodiment described above, the present invention is applied to an organic EL display apparatus wherein an organic EL element is used as an electro-optical element of the pixel 20, the present invention is not limited to this application. In particular, the present invention can be generally applied to all display apparatus which use an electro-optical element or light emitting element of the current driven type whose emission light luminance varies in response to the value of current flowing through the element such as an inorganic EL element, an LED (Light Emitting Diode) element or a semiconductor laser element.

Applications

The display apparatus according to the present invention described above can be applied as a display apparatus of such various electric apparatus as shown in FIGS. 13 to 17. In particular, the display apparatus can be applied to display apparatus of various electronic apparatus in various fields wherein an image signal inputted to or produced in the electronic apparatus is displayed as an image, such as, for example, digital cameras, laptop type personal computers, portable terminal apparatus such as portable telephone sets and video cameras.

By using the display apparatus according to the present invention as a display apparatus of electronic apparatus in various fields in this manner, as apparent from the foregoing description of the embodiment, the display apparatus according to the present invention can display an image of high quality in various kinds of electronic apparatus because it can achieve a sufficient effect of improvement of the display quality provided by a threshold value correction process.

It is to be noted that the display apparatus according to the present invention may be formed as such an apparatus of a module type having a sealed configuration. For example, the display apparatus in this instance may be a display module wherein the pixel array section 30 is adhered to an opposing portion of a transparent glass plate or the like. A color filter, a protective film, a light intercepting film or the like may be provided on the transparent opposing portion. It is to be noted that the display module may include a circuit section or a flexible printed circuit (FPC) for inputting and outputting signals and so forth from the outside to the pixel array section and vice versa.

In the following, particular examples of the electronic apparatus to which the display apparatus of the present invention is applied are described.

Figure 13:
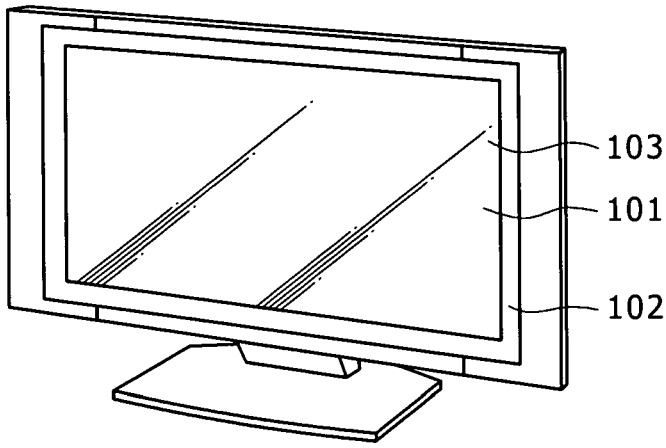
FIG. 13 is a perspective view showing an appearance of a television set to which an embodiment of the present invention is applied.

FIG. 13 shows a television set to which an embodiment of the present invention is applied. Referring to FIG. 13, the television set includes an image display screen section 101 including a front panel 102, a filter glass plate 103 and so forth and is produced using the display apparatus of the embodiment of the present invention as the image display screen section 101.

Figure 14A:
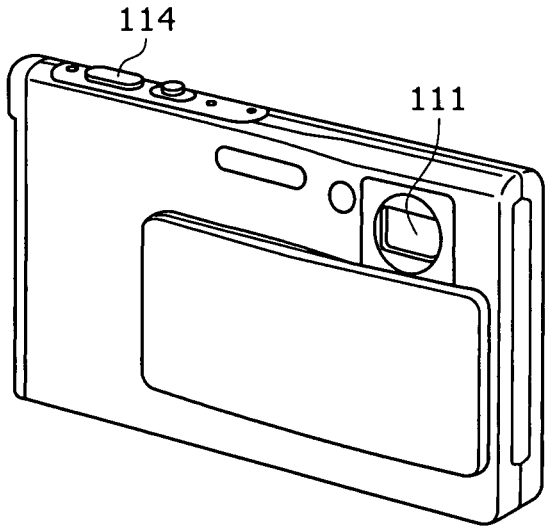
FIGS. 14A and 14B are perspective views showing appearances of a digital camera to which an embodiment of the present invention is applied as viewed from the front side and the rear side, respectively.
Figure 14B:
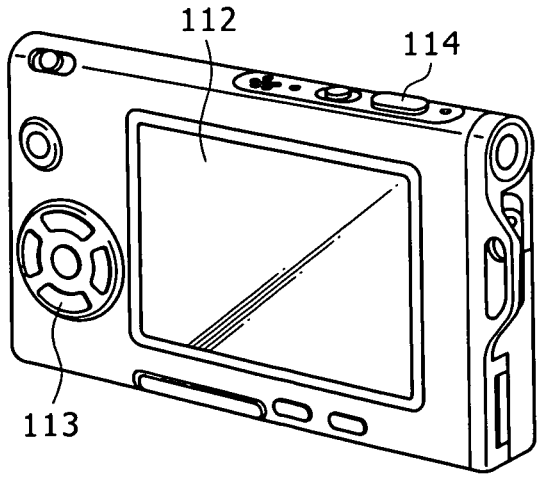

FIGS. 14A and 114B show an appearance of a digital camera to which another embodiment of the present invention is applied. Referring to FIGS. 14A and 14B, the digital camera shown includes a flash light emitting section 111, a display section 112, a menu switch 113, a shutter button 114 and so forth. The digital camera is produced using the display apparatus of the embodiment of the present invention as the display section 112.

Figure 15:
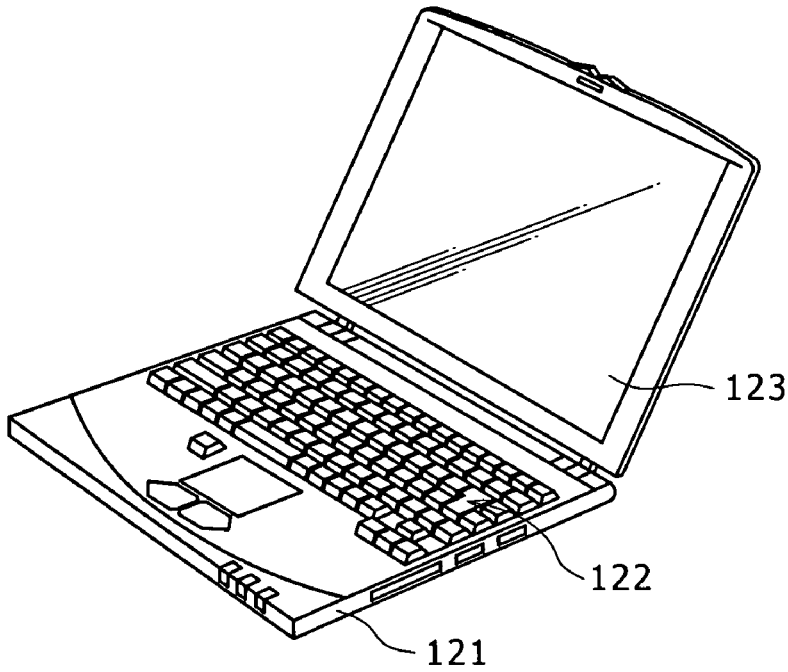
FIG. 15 is a perspective view showing an appearance of a laptop type personal computer to which an embodiment of the present invention is applied.

FIG. 15 shows a laptop type personal computer to which further embodiment of the present invention is applied. Referring to FIG. 15, the laptop type personal computer shown includes a body 121, a keyboard 122 for being operated in order to input characters and so forth, a display section 123 for displaying an image and so forth. The laptop type personal computer is produced using the display apparatus of the embodiment of the present invention as the display section 123.

Figure 16:
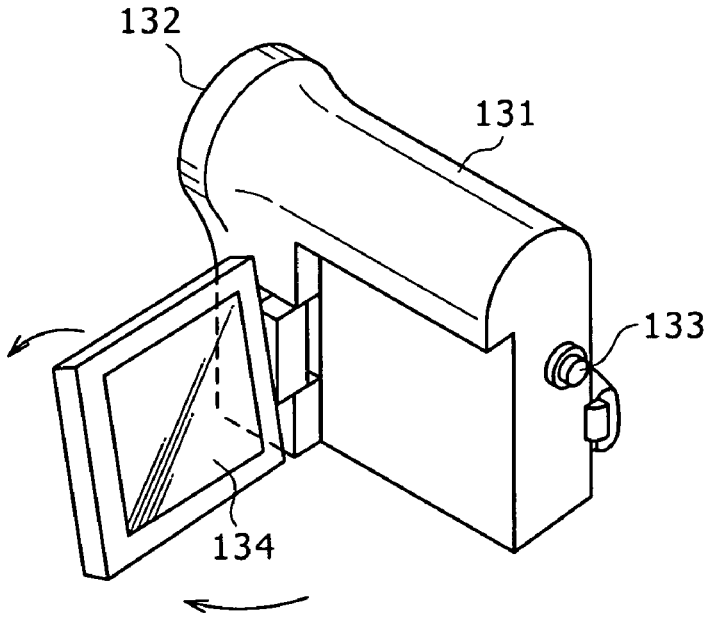
FIG. 16 is a perspective view showing an appearance of a video camera to which an embodiment of the present invention is applied.

FIG. 16 shows an appearance of a video camera to which still another embodiment of the present invention is applied. Referring to FIG. 16, the video camera shown includes a body section 131, and a lens 132 provided on a face of the body section 131 in a forward-looking manner for picking up an image of an image pickup object, a start/stop switch 133 for image pickup, a display section 134 and so forth. The video camera is produced using the display apparatus of the embodiment of the present invention as the display section 134.

FIGS. 17A to 17G show a portable terminal apparatus such as, for example, a portable telephone set to which yet another embodiment of the present invention is applied. Referring to FIGS. 17A to 17G, the portable terminal apparatus includes an upper side housing 141, a lower side housing 142, a connection section 143 in the form of a hinge section, a display section 144, a sub display section 145, a picture light 146, a camera 147 and so forth. The portable terminal apparatus is produced using the display apparatus of the embodiment of the present invention as the display section 144 or the sub display section 145.

While a preferred embodiment of the present invention has been described using specific terms, such description is for illustrative purposes only, and it is to be understood that changes and variations may be made without departing from the spirit or scope of the following claims.

What is claimed is:

1. A display apparatus, comprising:

a pixel array section having a plurality of pixels disposed in a matrix and each including an electro-optical element, a writing transistor connected at a gate electrode thereof to a scanning line and at a first one of electrodes thereof to a signal line, a driving transistor connected at a gate electrode thereof to a second one of the electrodes of said writing transistor, at a first one of electrodes of the driving transistor to a power supply line and at a second one of the electrodes thereof to an anode electrode of said electro-optical element, and a holding capacitor connected at a first one of electrodes thereof to the gate electrode of said driving transistor and at a second one of the electrodes thereof to the second electrode of said driving transistor;

a power supply scanning circuit configured to selectively supply a first power supply potential and a second power supply potential which is lower than the first power supply potential to said power supply line; and a signal outputting circuit configured to selectively output an image signal, a first reference potential, a second reference potential lower than the first reference potential and a third reference potential higher than the second reference potential to said signal line;

said power supply scanning circuit being operable to supply the second power supply potential to the second electrode of said driving transistor through said power supply line to initialize the potential of the second electrode of said driving transistor and then change over the potential of said power supply line from the second power supply potential to the first power supply potential;

said signal outputting circuit being operable to output, when said writing transistor is in a conducting state in response to a scanning signal supplied thereto through said scanning line, the first reference potential to said signal line so as to be supplied to the gate electrode of said driving transistor through said writing transistor to initialize the potential of the gate electrode of said driving transistor, supply, midway while a threshold value correction process of varying the potential of the second electrode of said driving transistor toward a potential which is the difference of a threshold voltage of said driving transistor from an initialization potential for the gate electrode of said driving transistor with reference to the initialization potential is carried out, the second reference potential to said signal line in place of the first reference potential so as to be supplied to the gate electrode of said driving transistor through said writing transistor, output the third reference potential in place of the second reference potential to said signal line within a period within which said writing transistor remains in the conducting state, and output the image signal in place of the third reference potential to said signal line after the threshold correction process ends.

2. The display apparatus according to claim 1, wherein the third reference potential is equal to or higher than the first reference potential.

3. The display apparatus according to claim 2, wherein the third reference potential is higher than the first reference potential and substantially equal to approximately one half a maximum amplitude level of the image signal.

4. The display apparatus according to claim 1, wherein the threshold value correction process is executed by a plural number of times over a plurality of horizontal scanning periods prior to one horizontal scanning period within which a signal writing process by said writing transistor of writing the image signal outputted from said signal outputting circuit to said signal line into the gate electrode of said driving transistor is carried out, and the pulse width of a scanning signal for the last-time threshold value correction process from among the scanning signals by which said writing transistor is placed into a conducting state for the individual times of execution of the plural number of times of the threshold value correction process is set greater than the pulse width of the scanning signal for the threshold value correction processes prior to the last-time threshold value correction process such that the third reference potential outputted from said signal outputting circuit to said signal line is written into the gate electrode of said driving transistor by said writing transistor.

5. The display apparatus according to claim 1, wherein, when the image signal outputted from said signal outputting circuit to said signal line is written into the gate electrode of said driving transistor by said writing transistor, a mobility correction process of negatively feeding back current flowing through said driving transistor to the gate electrode side of said driving transistor is executed parallelly.

6. A driving method for a display apparatus which includes a pixel array section having a plurality of pixels disposed in a matrix and each including an electro-optical element, a writing transistor connected at a gate electrode thereof to a scanning line and at a first one of electrodes thereof to a signal line, a driving transistor connected at a gate electrode thereof to a second one of the electrodes of the writing transistor, at a first one of electrodes thereof to a power supply line and at a second one of the electrodes thereof to an anode electrode of the electro-optical element, and a holding capacitor connected at a first one of electrodes thereof to the gate electrode of the driving transistor and at a second one of the electrodes thereof to the second electrode of the driving transistor, the driving method selectively changing over a potential of the power supply line to a first power supply potential and a second power supply potential which is lower than the first power supply potential, the driving method comprising the steps of:

supplying the second power supply potential to the second electrode of the driving transistor through the power supply line to initialize the potential of the second electrode of the driving transistor and then writing, when the writing transistor is in a conducting state, the first reference potential into the gate electrode of the driving transistor through the writing transistor to initialize the potential of the gate electrode of the driving transistor;

changing over the potential of the power supply line from the second power supply potential to the first power supply potential;

carrying out a threshold value correction process of varying the potential of the second electrode of the driving transistor toward a potential which is the difference of a threshold voltage of the driving transistor from an initialization potential for the gate electrode of the driving transistor with reference to the initialization potential;

writing a second reference potential lower than the first reference potential in place of the first reference potential into the gate electrode of the driving transistor through the writing transistor midway while the threshold value correction process is carried out;

writing a third reference potential higher than the second reference potential in place of the second reference potential into the gate electrode of the driving transistor through the writing transistor within a period within which the writing transistor remains in the conducting state; and writing an image signal in place of the third reference potential into the gate electrode of the driving transistor through the writing transistor which is placed into a conducting state again after the threshold correction process ends.

7. An electronic apparatus, comprising a display apparatus including:

a pixel array section having a plurality of pixels disposed in a matrix and each including an electro-optical element, a writing transistor connected at a gate electrode thereof to a scanning line and at a first one of electrodes thereof to a signal line, a driving transistor connected at a gate electrode thereof to a second one of the electrodes of said writing transistor, at a first one of electrodes thereof to a power supply line and at a second one of the electrodes thereof to an anode electrode of said electro-optical element, and a holding capacitor connected at a first one of electrodes thereof to the gate electrode of said driving transistor and at a second one of the electrodes thereof to the second electrode of said driving transistor;

a power supply scanning circuit configured to selectively supply a first power supply potential and a second power supply potential which is lower than the first power supply potential to said power supply line; and a signal outputting circuit configured to selectively output an image signal, a first reference potential, a second reference potential lower than the first reference potential and a third reference potential higher than the second reference potential to said signal line;

said power supply scanning circuit being operable to supply the second power supply potential to the second electrode of said driving transistor through said power supply line to initialize the potential of the second electrode of said driving transistor and then change over the potential of said power supply line from the second power supply potential to the first power supply potential;

said signal outputting circuit being operable to output, when said writing transistor is in a conducting state in response to a scanning signal supplied thereto through said scanning line, the first reference potential to said signal line so as to be supplied to the gate electrode of said driving transistor through said writing transistor to initialize the potential of the gate electrode of said driving transistor, supply, midway while a threshold value correction process of varying the potential of the second electrode of said driving transistor toward a potential which is the difference of a threshold voltage of said driving transistor from an initialization potential for the gate electrode of said driving transistor with reference to the initialization potential is carried out, the second reference potential to said signal line in place of the first reference potential so as to be supplied to the gate electrode of said driving transistor through said writing transistor, output the third reference potential in place of the second reference potential to said signal line within a period within which said writing transistor remains in the conducting state, and output the image signal in place of the third reference potential to said signal line after the threshold correction process ends.

* * * * *